US007455736B2

(12) United States Patent
Kashima et al.

(10) Patent No.: US 7,455,736 B2
(45) Date of Patent: Nov. 25, 2008

(54) HIGH TENSILE STRENGTH STEEL SHEET EXCELLENT IN PROCESSIBILITY AND PROCESS FOR MANUFACTURING THE SAME

(75) Inventors: Takahiro Kashima, Kakogawa (JP); Koichi Sugimoto, Nagano (JP)

(73) Assignees: Kabushiki Kaisha Kobe Seiko Sho, Kobe-shi (JP); Shinshu University, Matsumoto-shi (JP)

( * ) Notice: Subject to any disclaimer, the term of this patent is extended or adjusted under 35 U.S.C. 154(b) by 490 days.

(21) Appl. No.: 10/928,176

(22) Filed: Aug. 30, 2004

(65) Prior Publication Data

US 2005/0081966 A1 Apr. 21, 2005

(30) Foreign Application Priority Data

Aug. 29, 2003 (JP) ..... 2003-307463
Oct. 9, 2003 (JP) ..... 2003-351006

(51) Int. Cl.
*C22C 38/06* (2006.01)
*C22C 38/04* (2006.01)
*C21D 8/02* (2006.01)

(52) U.S. Cl. ..... 148/320; 420/8; 420/120; 428/659; 148/533; 148/651

(58) Field of Classification Search ..... 148/320, 148/533, 333–336, 651; 428/659; 420/8, 420/120

See application file for complete search history.

(56) References Cited

U.S. PATENT DOCUMENTS 6,280,538 B1 8/2001 Soshiroda et al.
6,306,527 B1 10/2001 Ikeda et al.
6,423,436 B1 * 7/2002 George et al. ..... 429/31

(Continued)

FOREIGN PATENT DOCUMENTS

EP 0 295 500 A1 12/1988

(Continued)

OTHER PUBLICATIONS

U.S. Appl. No. 10/928,176, filed Aug. 30, 2004, Kashima et al.

(Continued)

*Primary Examiner*—Deborah Yee
(74) *Attorney, Agent, or Firm*—Oblon, Spivak, McClelland, Maier & Neustadt, P.C.

(57) ABSTRACT

A high tensile strength steel sheet excellent in processibility which can satisfy a strength, a total elongation, and stretch-flanging property (hole enlarging rate) at a further high level. and comprises a matrix microstructure of tempered martensite or tempered bainite and, if necessary, ferrite, and a second phase of retained austenite, wherein (1) the steel comprising C: 0.10 to 0.6 mass %, Si: 1.0 mass % or smaller, Mn: 1.0 to 3 ,mass %, Al: 0.3 to 2.0 mass %, P: 0.02 mass % or smaller, S: 0.03 mass % or smaller, (2) a volume rate of retained austenite obtained by a saturated magnetization measuring method is 5 to 40% by area (whole field is 100%), and (3) a relationship of a carbon amount (C: weight %) in the steel, a volume rate (fγR) of retained austenite and a carbon concentration (CγR) of the retained austenite satisfies the equation:

$$(f\gamma R \times C\gamma R)/C \geqq 50 . \quad (I)$$

21 Claims, 7 Drawing Sheets

U.S. PATENT DOCUMENTS

| | | | | |
|---|---|---|---|---|
| 6,558,815 | B1 * | 5/2003 | Suzuki et al. | 428/659 |
| 6,709,535 | B2 | 3/2004 | Utsumi et al. | |
| 7,090,731 | B2 * | 8/2006 | Kashima et al. | 148/320 |
| 2003/0084966 | A1 | 5/2003 | Ikeda et al. | |
| 2004/0007298 | A1 | 1/2004 | Akamizu et al. | |
| 2004/0035500 | A1 | 2/2004 | Ikeda et al. | |
| 2004/0074575 | A1 | 4/2004 | Kashima et al. | |
| 2004/0159373 | A1 | 8/2004 | Ikeda et al. | |
| 2005/0081966 | A1 | 4/2005 | Kashima et al. | |

FOREIGN PATENT DOCUMENTS

| | | | |
|---|---|---|---|
| EP | 1 264 911 | A2 | 12/2002 |
| JP | 2003-96541 | * | 4/2003 |
| KR | 2001-0063691 | | 7/2001 |
| KR | 2002-0045212 | | 6/2002 |
| KR | 2003-0053834 | | 7/2003 |
| WO | WO 98/20180 | | 5/1998 |

OTHER PUBLICATIONS

Patent Abstracts of Japan, JP 06-145892, May 27, 1994.
Patent Abstracts of Japan, JP 05-311323, Nov. 22, 1993.
Korean Patent Abstracts, KR 10-2002-0045212 A, Jun. 19, 2002.
Korean Patent Abstracts, KR 10-2001-0063691 A, Jul. 9, 2001.
Korean Patent Abstracts, KR 10-2003-0053834 A, Jul. 2, 2003.
U.S. Appl. No. 11/290,640, filed Dec. 1, 2005, Ikeda, et al.
U.S. Appl. No. 11/736,813, filed Apr. 18, 2007, Kashima.
U.S. Appl. No. 11/910,013, filed Sep. 28, 2007, Kashima, et al.

* cited by examiner

HIGH TENSILE STRENGTH STEEL SHEET EXCELLENT IN PROCESSIBILITY AND PROCESS FOR MANUFACTURING THE SAME

BACKGROUND OF THE INVENTION

1. Field of the Invention

The present invention relates to a high tensile strength steel sheet excellent in processibility (stretch-flanging property and total elongation), and relates to technique for improving a TRIP (TRansformation Induced Plasticity) steel sheet.

2. Description of the Related Art

Steel sheets used for press molding in automobiles and industrial machines are required to have both of excellent strength and processibility, and such property requirements have been recently increased gradually. In order to respond to such demands, recently, TRIP steel sheets have been attractive and paid attention. TRIP steel sheets have a retained austenite, and the retained austenite (γR) is induced—transformed into martensite by a stress, and a great elongation is exhibited when processed and deformed at a temperature of a martensite transformation initiating temperature (Ms point) or higher. For example, TRIP—type composite steels (PF steel) comprising polygonal ferrite+bainite+retained austenite, and TRIP—type bainite steels (BF steel) comprising bainitic ferrite+retained austenite+martensite are known. However, the PF steel is inferior in stretch-flanging property, and the BF steel is excellent in stretch-flanging property, but has a defect that elongation is small.

Then, in order to provide a steel sheet which maintains excellent in balance between strength and elongation due to the retained austenite and also excellent in moldability such as stretch-flanging property (hole enlarging property), various studies have been performed. For example, the following Patent Publications 1 to 4 teach that steel sheets comprising a matrix microstructure of tempered martensite, tempered bainite and the like, and also a second phase microstructure of retained austenite, are excellent in all of strength, elongation and stretch-flanging property (U.S. Patent Application Publication No.: US-2004-0074575-A1). These steel sheets are manufactured by, for example, steps of adjusting a cooling rate after hot rolling to introduce a martensite and a bainite, performing cold rolling, and then cooling the plate from a ferrite-austenite two phase region temperature in a specific pattern to produce retained austenite.

SUMMARY OF THE INVENTION

Therefore, an object of the present invention is to provide a steel sheet which can satisfy balance between a strength, a total elongation and a stretch-flanging property (hole enlarging rate) at a considerably high level.

In order to achieve the aforementioned object, the present inventors intensively studied and, as a result, found the following facts:

1) If a steel material comprising a second phase (microstructure containing retained austenite) structure in which a content of Al in the steel material is relatively increased, and a carbon amount (C) in the steel, a volume rate (fγR) of retained austenite occupied in the steel, and a carbon concentration (CγR) in the retained austenite satisfy a predetermined relationship, the resulting steel can satisfy strength, a total elongation a stretch-flanging property (hole enlarging rate) at a further high level.

2) In addition, it has been also found that, if a steel material can satisfy the above relationship of carbon amount (C), volume rate (fγR) of retained austenite and carbon concentration (CγR) in the retained austenite, a properly control rolling reduction rate at cold rolling prior to thermal treatment (2 phase region heating) for producing retained austenite, and also a retaining process in a predetermined temperature region for a predetermined time after cold rolling are effective to improve the strength, the total elongation and the stretch flanging property.

The present invention was made on the basis of these findings.

According to the first aspect of the present invention, there is provided a high tensile strength steel sheet excellent in processibility which comprises a matrix and a second phase, the matrix comprising at least tempered martensite or tempered bainite and, if necessary, ferrite as a constituent microstructure, and the second phase comprising retained austenite as a constituent, wherein (1) the steel sheet comprises a steel satisfying C: 0.10 to 0.6 weight %, Si: 1.0 weight % or smaller, Mn: 1.0 to 3 weight %, Al: 0.3 to 2.0 weight %, P: 0.02 weight % or smaller, S: 0.03 weight % or smaller, (2) a volume rate of retained austenite obtained by a saturated magnetization measuring method is 5 to 40% by area (whole field is 100%), and (3) a relationship of a carbon amount (C: weight %) in the steel, a volume rate (fγR) of retained austenite and a carbon concentration (CγR) of the retained austenite satisfies the following equation (I):

$$(f\gamma R \times C\gamma R)/C \geqq 50 \quad \text{(I)}$$

The high tensile strength steel sheet may further contain (a) an element for controlling the form of sulfide such as Ca: 0.003% by mass or smaller, and REM: 0.003% by mass or smaller, (b) an element for strengthening precipitation and finely dividing a microstructure such as Nb: 0.1% by mass or smaller, Ti: 0.1% by mass or smaller, and V: 0.1% by mass or smaller, and (c) an element for stabilinng retained austenite such as Mo: 2% by mass or smaller, Ni: 1% by mass or smaller, Cu: 1% by mass or smaller, and Cr: 2% by mass or smaller.

Preferable area rates (an area of a whole photograph is 100%) of tempered martensite, tempered bainite and ferrite are, when measured with an optical microscope photograph, as follows:

Tempered martensite or tempered bainite: 20 to 90% by area

Ferrite: 0 to 60% by area

It is desirable that the retained austenite contains lath-like retained austenite having a long axis/short axis ratio of 3 or larger at 60% by area relative to total retained austenite.

In the high tensile strength steel sheet of the present invention, even when a tensile strength (TS) is 750 to 1050 MPa, a tensile strength (TS), a total elongation (E1) and a hole enlarging rate (λ) satisfy a relationship of the following equation:

$$TS \times E1 \geqq 22{,}000, TS \times \lambda \geqq 20{,}000$$

[wherein TS represents result of measurement of a tensile strength (unit: MPa), E1 represents result of measurement of a total elongation (unit: %), and λ represents result of measurement of a hole enlarging rate (unit: %)]

The high tensile strength steel sheet of the present invention includes a steel sheet in a naked state, as well as a steel sheet having a surface which has been rust proofing-processed by galvanizing, more specifically melting-galvanizing, further specifically melting-alloy-galvanizing in order to suppress rusting during storage or conveyance or during use to suppress quality deterioration.

According to the second aspect of the patent invention, there is provided a method of preparing a high tensile strength steel sheet which comprises steps of providing a steel sheet comprising C: 0.10 to 0.6% by mass, Si: 1.0% by mass or smaller (including 0% by mass), Mn: 1.0 to 3% by mass, Al: 0.3 to 2.0% by mass, P: 0.02% by mass or smaller, and S: 0.03% by mass or smaller, with a martensite or bainite introduced therein and cold rolling a steel sheet at rolling reduction rate of 30% or smaller, thereafter, or without performing cold rolling, heating the steel sheet to a ferrite-austenite 2-phase region temperature, and then retaining the steel sheet in a temperature range of 450 to 550° C. for 10 to 500 seconds.

In addition, when a galvanized, more specifically, melting-alloy-galvanized steel sheet is manufactured by the present invention process, it is possible not only to perform plating treatment or alloy heating treatment after the 2-phase region temperature region heating step and/or retaining step in a temperature range of 450 to 550° C. and, thereafter, but also to perform melting-galvanizing, further, alloy heating treatment of the plated layer from the 2-phase region temperature region heating or retaining step in a temperature region of 450 to 550° C., whereby, a galvanized steel sheet, or further an alloy heat-treated steel sheet thereof can be effectively obtained.

The present invention includes in its technical scope the aforementioned high tensile strength steel sheet and a galvanized article thereof and, further, various steel parts obtained by processing an alloy heat-treated steel sheet thereof.

According to the present invention, there can be provided a second-phase (microstructure including retained austenite) steel sheet and a galvanized steel sheet which can satisfy a strength, a total elongation, and stretch-flanging property (hole enlarging rate) at a further high level.

BRIEF DESCRIPTION OF THE DRAWINGS

The above and other objectives and features of the present invention will become more apparent from the following description of preferred embodiments thereof with reference to the accompanying drawings throughout which like parts are designated by like reference numerals, and wherein.

BEST MODE FOR CARRYING OUT THE INVENTION

[Microstructure]

Figure 1:
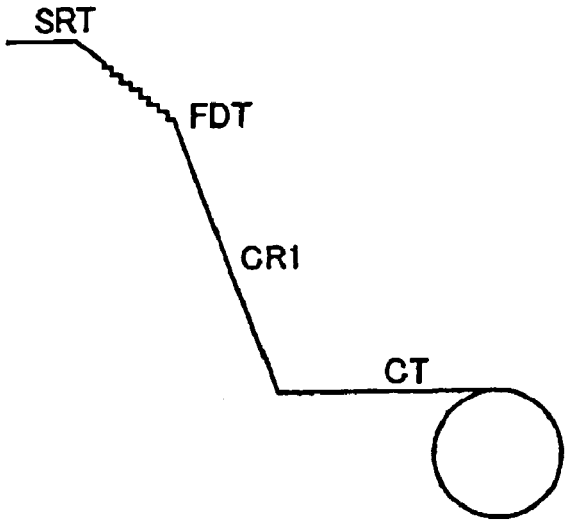
FIG. 1 is a view showing one example of a hot rolling and cooling step adopted in Examples.

The steel sheet of the present invention is characterized by a microstructure and a component. First, the microstructure characterizing the present invention will be explained.

A metal microstructure of the steel sheet of the present invention observed with an optical microscope has a matrix microstructure and a second-phase which is dispersed in the matrix in an island manner. According to an optical microscope photograph, the matrix exhibits gray color, and is constructed of at least a tempered martensite or a tempered bainite. The matrix may contain a ferrite in addition to the tempered martensite or the tempered bainite, in some cases. On the other hand, the second phase (island-like phase) exhibits white color in an optical microscope photograph, and is constructed of retained austenite. In addition, a black part constructed of cementite is observed in some times, and the black part is contained in the second-phase microstructure in that the part is dispersed in an island manner.

It is an important point that the steel sheet of the present invention has the aforementioned microstructure, in order to balance a strength, a total elongation, and stretch-flanging property sole enlarging rate) at a high level. That is, the tempered martensite and the tempered bainite are characterized in that crystal particles are lath-like and high in a hardness, but have a smaller translocation density and are soft as compared with the conventional martensite and bainite. These "tempered martensite and tempered bainite" and "martensite and bainite" can be discriminated by observation, for example, with a transmission electron microscope "TEM". Existence of "tempered martensite" and "tempered bainite" as a matrix becomes an important factor for enhancing both of a total elongation and stretch-flanging property.

The aforementioned matrix may contain ferrite in addition to the aforementioned tempered martensite and tempered bainite. This ferrite is correctly polygonal ferrite, that is, ferrite having a small translocation density. When ferrite is contained, the stretch flanging property can be further enhanced. For example, when an area rate of a phase is measured with an optical microscope photograph, a TEM photograph or hardness measurement (microstructures can be discriminated by a TEM observation or hardness measurement), area rates of tempered martensite, tempered bainite and ferrite (area of whole photograph is 100%) described below become an index.

Tempered martensite or tempered bainite: 20% by area or larger (e.g. 25% by area or larger, or 30% by area or larger), 90% by area or smaller (e.g. 65% by area or smaller, or 50% by area or smaller)

Ferrite: 0% by area or larger (e.g. 10% by area or larger, or 15% by area or larger), 60% by area or smaller (e.g. 50% by area or smaller, or 40% by area or smaller)

Retained austenite is an essential microstructure for exerting TRIP (transformation induced plasticity) effect, and is useful for improving a total elongation. An amount of retained austenite can be measured by a saturated magnetization measuring method and, letting a total to be 100%, 5% by volume or larger (preferably 8% by volume or larger, further preferably 10% by volume or larger) is desirable. However, when retained austenite becomes too much, stretch-flanging property (hole enlarging rate) tends to deteriorate, therefore, retained austenite is desirably 40% by volume or smaller preferably 30% by volume or smaller, further preferably 20% by volume or smaller).

In the conventional TRIP steel sheet, retained austenite is present in an old austenite grain boundary in a random orientation, while in the present invention, there is also characteristic that retained austenite is present in a substantially same orientation along a block boundary in the same packet.

Although it is desirable that the matrix and the second phase are substantially formed of the aforementioned microstructure, other microstructures (perlite, tempered bainite when the matrix is a tempered martensite, tempered martensite when the matrix is a tempered bainite) inevitably remaining in a manufacturing step, and precipitates are allowable.

In the steel sheet of the present invention, it is desirable that the retained austenite is lath-like (needle like) form. The reason is that TRIP steel sheet having lath-like retained austenite not only has TRIP (transformation induced plasticity) effect equivalent to that of TRIP steel sheet having spherical retained austenite, but also further remarkable effect of improving stretch-flanging property is recognized. It is desirable that lath-like retained austenite having a long axis/short axis ratio of 3 or larger is, for example, 60% by area or larger, preferably 65% by area or larger, further preferably 70% by area or larger relative to total retained austenite.

[Component]

Then, chemical components of the steel sheet of the present invention will be explained. Hereinafter, all of units of chemical components mean % by mass.

C: 0.10 to 0.6%

C is an essential element for securing a high strength, and for securing retained austenite. More particularly, C is an important element for bringing sufficient C into an austenite phase as a solid solution, and making a desired austenite phase remain even at room temperature, and is useful for enhancing balance between strength and stretch-flanging property. An amount of C is 0.10% or larger, preferably 0.13% or larger, further preferably 0.15% or larger. However, when C becomes excessive, not only its effect is saturated, but also defects are easily caused due to central segregation during a casting stage. Therefore, an amount of C is 0.6% or smaller, preferably 0.5% or smaller, further preferably 0.4% or smaller. When an amount of C exceeds 0.3%, weldability tends to decrease. Therefore, it is recommended that an amount of C is 0.3% or smaller, preferably 0.28% or smaller, further preferably 0.25% or smaller also in view of weldability.

Si: 1.0% or smaller (including 0%)

Si is useful as an element for reinforcing a solid solution, and is an element useful for suppressing production of carbide due to decomposition of retained austenite. However, when Si is too much, surface treating property (phosphoric acid treatment property and galvanizing property) is deteriorated, and additionally, processibility (stretch-flanging property and total elongation) is adversely effected. Therefore, it is desirable to suppress an amount of Si to at most 1.0% or smaller, more preferably 0.8% or smaller.

Al: 0.3to2.0%

Al is an element useful for suppressing production of carbide due to decomposition of, particularly, retained austenite, and is contained at 0.3% or larger, more preferably 0.5% or larger. However, since when Al is too much, hot shortness easily occurs. Therefore, an amount of Al is 2.0% or smaller, more preferably 1.8% or smaller. Almost all of the conventional TRIP steel sheets including those described in the aforementioned Patent Publications have a content of Al of 0.1% or smaller and, as far as the present inventors know, there has been no TRIP steel sheet in which a content of Al is positively increased to 0.3% or larger at an Example level. The reason seems that it was thought that Al is a source of oxide based inclusions adversely effecting processibility and hot shortness. However, according to study by the present inventors, as will be described in detail below, it was found that a steel sheet in which a content of Al is increased to a 0.3 to 2.0% level gives a TRIP steel sheet exhibiting a high value also in a total elongation and stretch-flinging property while maintaining a high strength, in cooperation with other component composition and microstructure control.

Mn: 1.0 to 3%

Mn is an element useful for stabilizing austenite, and maintaining retained austenite at a prescribed amount or larger. Therefore, Mn is 1.0% or larger, preferably 1.2% or larger, further preferably 1.3% or larger. On the other hand, when an amount of Mn becomes excessive, it becomes a cause for casting one side cracking. Therefore, an amount of Mn is 3% or smaller, preferably 2.5% or smaller, further preferably 2.0% or smaller.

P: 0.02% or smaller

P is an element useful for maintaining desired retained austenite, and its effect is exerted by an amount of P of 0.001% or larger, more preferably 0.005% or larger, but when an amount of P is excessive, secondary processibility is deteriorated. Therefore, an amount of P should be suppressed to 0.02% or smaller, preferably 0.015 or smaller.

S: 0.03% or smaller

S is a harmful element which forms a sulfide based inclusions such as MnS, and becomes an origin of cracking, deteriorating processibility. Therefore, it is desirable to reduce an amount of S as much as possible. Accordingly, S is 0.03% or smaller, preferably 0.01% or smaller, further preferably 0.005% or smaller.

The steel sheet of the present invention may contain the following components in addition to the aforementioned components.

At least one selected from Ca: 0.003% or smaller and REM: 0.003% or smaller

These Ca and REM rare earth element) are both an element effective for controlling a form of sulfide in the steel, and improving processibility. Examples of the rare earth element include Sc, Y, and lanthanoid. In order that the aforementioned action is effectively exerted, it is recommended that each of them is contained at 0.0003% or larger particularly 0.0005% or larger). However, even when each of them is added excessively, the effect is saturated and the economical efficiency is reduced. Therefore, it is better to suppress an amount thereof to 0.003% or smaller (particularly 0.002% or smaller).

At least one selected from Nb: 0.1% or smaller, Ti: 0.1% or smaller, and V: 0.1% or smaller These Nb, Ti and V have the effect of strengthening precipitation and finely dividing a microstructure, and are an element useful for highly strengthening. In order that such the action is effectively exerted, it is recommended that each of them is contained at 0.01% or larger (particularly 0.02% or larger). However, even when each of them is added excessively, the effect is saturated and economical efficiency is reduced. Therefore, an amount of each of them is 0.1% or smaller (preferably 0.08% or smaller, further preferably 0.05% or smaller).

At least one is selected from Mo: 2% or smaller, Ni: 1% or smaller, Cu: 1% or smaller, and Cr: 2% or smaller These Mo, Ni, Cu and Cr are useful as an element for reinforcing the steel, and at the same time, are elements having similarly effectiveness useful for stabilizing retained austenite. In order that such the action is effectively exerted, it is better that each of them is contained at 0.05% or larger (particularly 0.1% or larger). However, even when each of them is added excessively, the effect is saturated and is not economical. Therefore, an amount of Mo and Cr each is 2% or smaller (preferably 1% or smaller, more preferably 0.8% or smaller), and an amount of Ni and Cu each is 1% or smaller (preferably 0.5% or smaller, more preferably 0.4% or smaller).

The steel sheet of the present invention may futer contain other elements as far as the aforementioned microstructure characteristic is satisfied, or a remaining part may be Fe and inevitable impurities.

The steel sheet of the present invention is constructed of specified components and specified microstructures as described above and, as other characteristic factor, it becomes important for improving balance between a strength, a total elongation, and stretch-flanging property (hole enlarging rate) to a far higher level that a relationship between a carbon amount (C: % by mass) in the steel, a volume rate (fγR) of the aforementioned retained austenite and a carbon concentration (CγR) in the aforementioned retained austenite satisfies a relationship of the following equation (I):

$$(f\gamma R \times C\gamma R)/C \geqq 50 \quad \text{(I)}$$

When a value of the (I) equation is less than 50, a strength exhibits a high value, but a total elongation and stretch-flanging property are reduced as can be confirmed also in Examples below, and an object of the present invention is not achieved. A more preferably value of the (I) equation is 55 or more.

Incidentally, fγR represents an amount of retained austenite, CγR is an index for showing stability of the retained austenite and, when a value of (fγR×CγR) is higher, a larger amount of more stable retained austenite is present, and plasticity organic transformation (TRIP) effect is effectively exerted. Therefore, when this value is relatively larger relative to C, and a value of the equation (I) is large (50 or larger), it is thought that this is an important factor for enhancing a total elongation and stretch-flanging property.

In the steel sheet of the present invention, by satisfying the specified microstructures and the specified components described-above, and maintaining a value of the (I) equation of 50 or larger, a strength, a total elongation, and stretch-flanging property (hole enlarging rate) are balanced at an extremely high level. And, the steel sheet of the present invention satisfying the aforementioned factors, even when a tensile strength is 750 to 1050 MPa (that is, around 780 MPa to around 980 MPa), have both of excellent total elongation and excellent stretch-flanging property (hole enlarging rate), for example, it also becomes possible that a tensile strength (TS), a total elongation (E1), and a hole enlarging rate (λ) satisfy a relationship of the following equation:

$$TS \times E1 \geqq 22{,}000,\ TS \times \gamma \geqq 20{,}000$$

[wherein TS represents result of measurement of a tensile strength (unit: MPa), E1 represents result of measurement of a total elongation (unit: %), and γ represents result of measurement of hole enlarging rate (unit: %)].

The steel sheet of the present invention satisfying the aforementioned defining requirements stably exhibits excellent processibility due to an appropriate composition and a metal microstructure thereof. Its property is of course effectively exerted as a naked steel sheet, and additionally, its characteristic is sufficiently exerted as a surface-treated steel sheet which has been subjected to, for example, phosphate treatment, or as a plated steel sheet which has been subjected to, for example, plating treatment such as melting-galvanizing, further, alloy heating treatment.

[Manufacturing Process]

The aforementioned TRIP steel sheet of the present invention can be manufactured by cold rolling a steel sheet (a composition of components is common with that of TRIP steel sheet) with a martensite (not tempered martensite; quenched martensite) or a bainite (or tempered bainite) introduced therein at rolling reduction rate of 30% or smaller, and thereafter, or without performing cold rolling, soaking (or uniformly heating) at a ferrite-austenite 2 phase region temperature and retaining at a temperature region of 450 to 550° C. for 10 to 500 seconds.

When a steel sheet with a martensite or a bainite introduced therein (including a steel sheet having a martensite-ferrite, or bainite-ferrite) is burned at a 2 phase region, and thereafter, retained at a predetermined temperature region for a predetermined time, a second phase (phase containing retained austenite) different from a matrix (tempered martensite, tempered bainite etc.) can be produced. And, when cold rolling is performed under an appropriate condition prior to this heat treatment, an appropriate second phase (phase containing retaining austenite) can be formed at the heat treatment, and consequently, a total elongation and stretch-flanging property (hole enlarging rate) can be remarkably improved. It is better that a rolling reduction rate at this time is specifically set around 0% or larger (preferably 5% or larger, further preferably 10% or larger), and 30% or smaller (preferably 25% or smaller, further preferably 20% or smaller).

Meanwhile, the aforementioned rolling reduction rate contributes also to increase an amount of lath-like retained austenite, and as rolling reduction rate grows smaller, an amount of lath-like retained austenite is increased. In the present invention, since rolling reduction rate is defined as described above, it is difficult to drastically change an amount of lath-like austenite by greatly changing rolling reduction rate. However, when it is intended to increase an amount of lath-like retained austenite, smaller rolling reduction rate may be selected from the relevant range, or cold-rolling may be omitted in some cases.

A steel sheet with a martensite or a bainite introduced therein can be obtained by a conventional method That is, by rapidly cooling a temperature of a steel sheet heated to an austenite region to a temperature of Ms point or lower, a martensite can be introduced. And, by rapidly cooling a temperature of the steel sheet to a temperature of not lower than Ms point and not higher than Bs point, and thereafter, transforming the steel sheet at a constant temperature, a bainite can be introduced. In addition, a ferrite can be introduced by setting a cooling pattern so that the steel sheet passes through a ferrite transformation region in a continuous cooling transformation curve (CCT curve). Since a perlite is not desirable in the present invention, it is desired to set a cooling pattern so that a perlite transformation region is avoided.

Meanwhile, when an object is to produce a martensite or a bainite, a method of rapidly cooling to a predetermined temperature monotonously is simple, but when it is intended to produce also a ferrite, since it is difficult to stably introduce a ferrite by monotonous cooling, it is better to adopt a multi-stage cooling method of setting a cooling rate by dividing into plural times. In particular, a method of retaining an austenite-ferrite 2 phase region temperature and initiating cooling again is recommended. When any of the aforementioned cooling patterns is adopted, it is recommended that a cooling rate is, for example, 10° C./sec or larger (preferably 20° C./sec or larger).

In view of practical operation, it is effective to perform introduction of a martensite or a bainite during a cooling process after hot rolling. In this case, it is recommended to adjust a hot-rolling finishing temperature (FDT) to around (Ar3-50) ° C. and to cool a steel by any of aforementioned various cooling patterns and then roll up it at a temperature of a Ms point or lower (in the case of introduction of a martensite), or a temperature of not lower than Ms point and not larger than Bs point (n the case of introduction of a bainite). A hot rolling starting temperature (SRT) can be selected from such a range that the aforementioned finishing temperature can be maintained, and is, for example, around 1000 to 1300° C.

Heat-treating method after cold rolling will be explained in further detail as follows:

Heating to a ferrite-austenite 2 phase region temperature (not lower than an A1 point and not higher than an A3 point) is for the purpose of producing an austenite while leaving a martensite and a bainite. A heating time at the 2 phase region temperature can be appropriately selected depending on a setting amount of each of tempered martensite, tempered bainite and retained austenite in a desired TRIP steel sheet, and is different depending on a heating temperature and a cooling rate thereafter, therefore, it is difficult to equally define, but can be selected from a range of, for example, 10 seconds or longer (preferably 20 seconds or longer, further preferably 30 seconds or longer) and 600 seconds or shorter (preferably 500 seconds or shorter, further preferably 400 seconds or shorter). When a heating time is too short, a retained austenite is deficient and, when a heating temperature is too long, a tempered martensite, or a tempered bainite is deficient (or a lath-like microstructure, which is characteristic in tempered martensite and tempered bainite, is damaged), and at the same time, a retained austenite becomes coarse, or easily degrade to carbide.

Rapid cooling from a 2 phase region temperature is for the purpose of avoiding ferrite transformation, perlite transformation and bainite transformation. Specifically, a steel sheet is cooled at such a rate that a Fs line, a Ps line or a Bs line in a CCT curve can be avoided (e.g. rate of 3° C./sec or larger, preferably around 5° C./sec or larger).

Then, cooling to a temperature of 450° C. or higher (preferably 470° C. or higher) and 550° C. or lower (preferably 530° C. or lower) and thereafter retaining at the temperature region is for the purpose of securing an amount of retained austenite by lowering a Ms point of an austenite phase. A time for soaking at the temperature region is appropriately set depending on an amount of an austenite produced at the 2 phase region temperature and an amount of retained austenite to be set in a desired TRIP steel sheet, and at least 10 seconds or longer (preferably 50 seconds or longer) should be secured. However, when an austemper time is too long, bainite transformation proceeds and an amount of retained austenite is reduced. Therefore, the time should be suppressed to 500 seconds or shorter, more preferably 200 seconds or shorter.

In view of actual operation, the aforementioned heat treatment after cold rolling is conveniently performed by using continuous annealing facilities. In addition, when the cold rolled sheet is subjected to galvanizing, for example, melting-galvanizing, it is possible to perform melting-galvanization after heat-treatment under the aforementioned appropriate condition, and further perform its alloy heat-treatment. Further, it is also possible to set so that a part of galvanizing condition or its alloy heat-treating condition satisfies the aforementioned heat treatment condition, and perform the aforementioned heat-treatment at the plating step.

Since the thus obtained steel sheet of the present invention and its melting-galvanized article are excellent in not only a strength but also a total elongation and stretch-flanging property, they can be easily processed. For this reason, steel parts having a high strength can be provided.

EXAMPLES

The following Examples illustrate the present invention more specifically, but the present invention is not restricted by the following Examples, the present invention can be of course practiced by appropriate variation in such a range that the above-and later-described gist is adopted, and they are all included in the technical scope of the present invention.

Example 1

Figure 2:
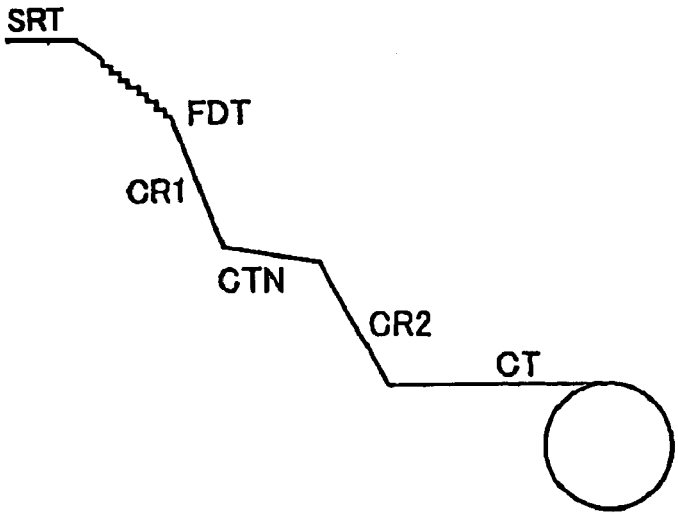
FIG. 2 is a view showing another hot rolling and cooling step adopted in Examples.

A test steel having a component composition described in the following Table 1 (unit is % by mass in Table) was melted in vacuum and produced into an experimental slab having a thickness of 20 to 30 mm and, thereafter, manufactured into a hot rolled-sheet having a sheet thickness of 2.5 mm by a hot rolling-1 stage (monotonous) cooling pattern shown in FIG. 1 or a hot rolling-2 stage cooling pattern shown in FIG. 2, which was further cold rolled to manufacture a cold rolled sheet having a sheet thickness of 2.0 mm. This cold rolled sheet was heated to a ferrite-austenite 2 phase region temperature (830° C.), burned by retaining for 120 seconds, and subjected to heat-treatment by rapidly cooling to a predetermined temperature and retaining for a predetermined time, to manufacture a TRIP steel sheet. Symbols in FIG. 1 and FIG. 2 have the following meanings:

SRT: hot rolling heating temperature

FDT: hot rolling finishing temperature

CR1: cooling rate at first stage

CTN: retaining temperature after cooling at first stage

CR2: cooling rate at second stage

CT: rolling up temperature

Conditions of the aforementioned hot rolling 1 stage or 2 stage cooling, a microstructure of hot rolled sheet, rolling reduction rate during cold rolling, soaking temperature, an austemper temperature and an austemper time are shown in the following Tables 2, 4 and 6. A microstructure of the resulting TRIP steel sheet, a value of the equation (I), a tensile strength (TS), a total elongation (E1), stretch-flanging property (hole enlarging rate: λ), and phosphoric acid treating property are shown in the following Tables 3, 5 and 7.

Figure 3:
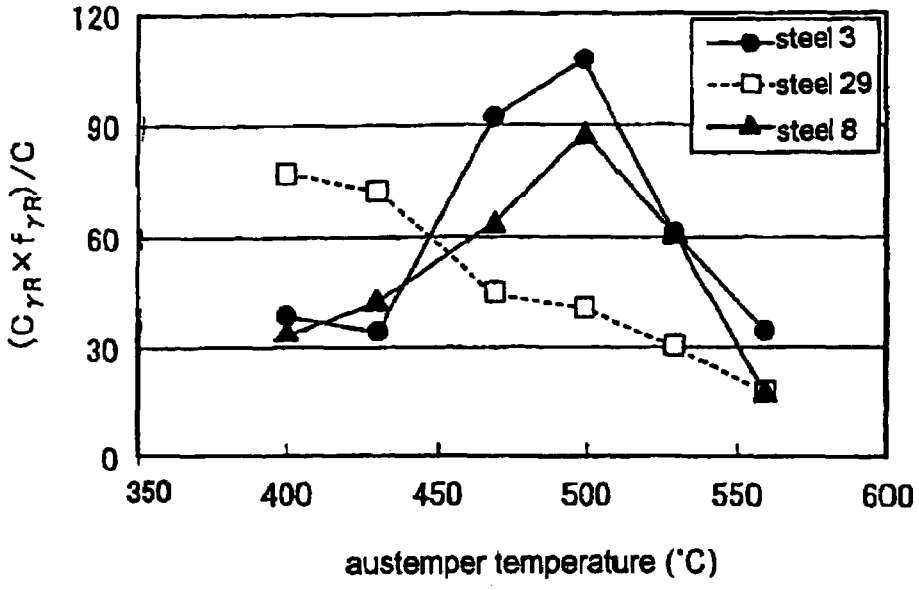
FIG. 3 is a graph showing influence of an austemper temperature after soaking on a value of the equation (I)
Figure 4:
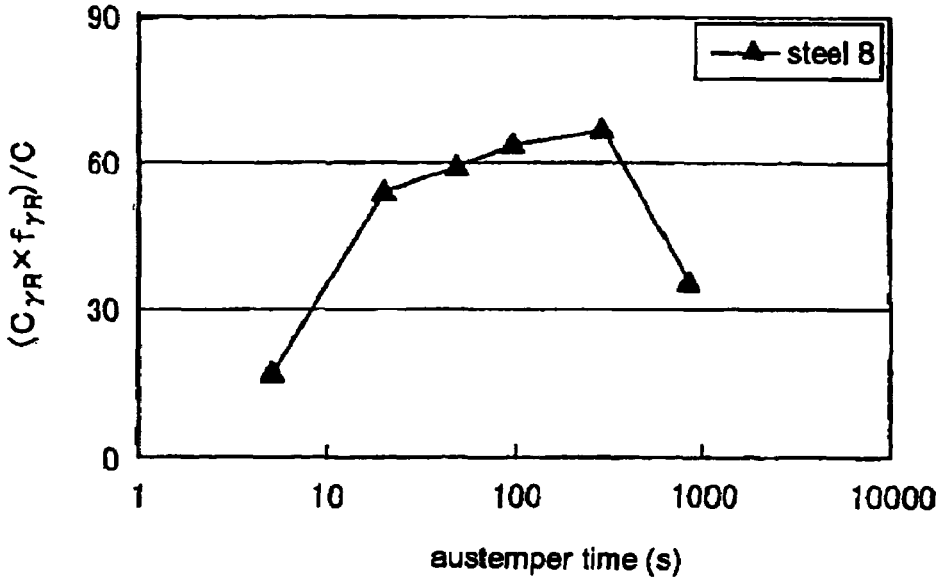
FIG. 4 is a graph showing influence of an austemper time after soaking on a value of the equation (I)
Figure 5:
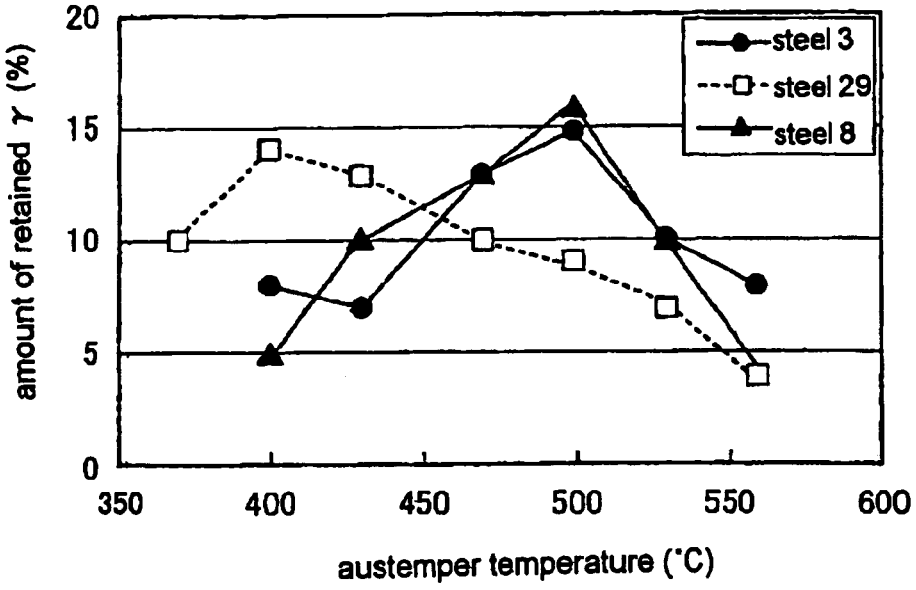
FIG. 5 is a graph showing influence of an austemper temperature after soaking on an amount of retained austenite in the resulting steel sheet.
Figure 6:
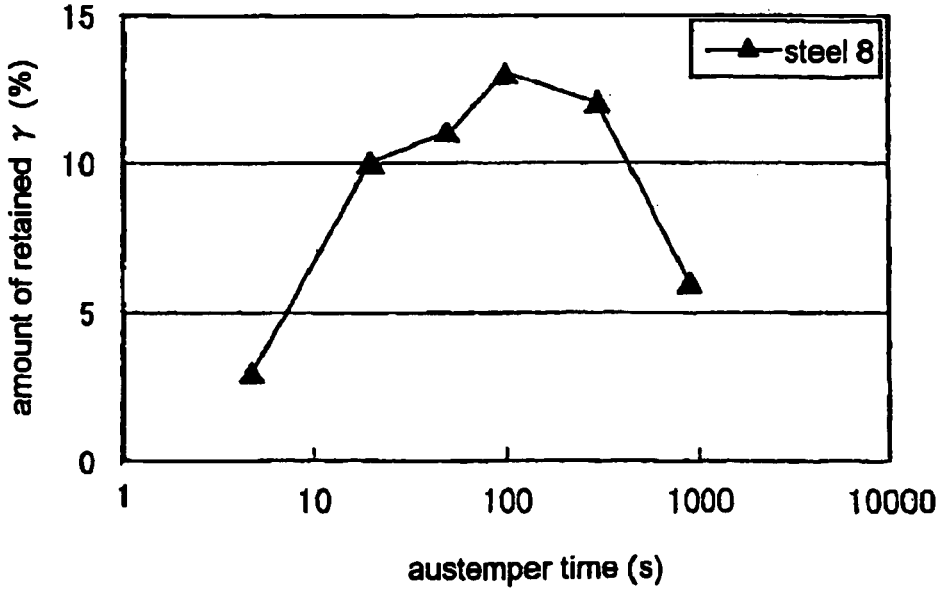
FIG. 6 is a graph showing influence of an austemper time after soaking on an amount of retained austenite in the resulting steel sheet.

In addition, from data of the following Tables 2 to 7, regarding some samples having different Al contents, effect of an austemper temperature and an austemper time after hot rolling and cold rolling, and then, soaking on a value of the equation (I) are shown in FIGS. 3 and 4, and similarly, effect of an austemper temperature and an austemper time after the same soaking on an amount of retained austenite is shown in FIGS. 5 and 6.

Microstructures of hot rolled sheets and TRIP steel sheets shown in the aforementioned Tables 2 to 7 were investigated as follows: That is, the steel sheets were Lepera-etched, the microstructures were identified by observation with a transmission electron microscope (TEM; 15,000-fold magnification), and an area rate of each of tempered martensite, tempered bainite and ferrite was calculated based on an optical microscope photograph (1,000-fold magnification). In addition, a ratio of lath-like retained austenite retained austenite having a long axis/short axis ratio of 3 or larger) relative to total retained austenite was also measured based on the optical microscope photograph. On the other hand, a volume rate of retained austenite was measured by measurement of saturated magnetization [see JP-A No. 2003-90825, and "R & D Kobe Seiko Giho" Vol.52, No. 3 (December 2002)], and a C concentration in retained austenite was measured with a X-ray microanalyzer (XMA) after grinding of a steel sheet to a ¼ thickness and chemical polishing (ISIJ Int. Vol.33, 1993, No. 7, P.776).

A tensile strength (TS) and a total elongation (E1) were measured using JIS No. 5 test pieces, and stretch-flanging property was assessed by preparing test pieces having a diameter of 100 mm and a sheet thickness of 2.0 mm, subjecting a central part of the piece to punching procession to perforate a hole having a diameter of 10 mm, then subjecting to hole enlarging procession with a 60° conical punching on a burr, and measuring a hole enlarging rate (λ) at a crack penetrating time (JFST1001; Standard from The Japan Iron and Steel Federation).

In addition, phosphoric acid treating property and Fe concentration in galvanizing were obtained by the following manners.

[Phosphoric Acid Treating Property]

Each test steel sheet is immersed in a phosphate treating solution (trade name "LB-L3020" manufactured by Nihon Parkerizing Co., Ltd) at 43° C. for 2 minutes, pulled out, and dried, and then a surface thereof is observed with SEM (2,000-fold magnification) to investigate status of attachment of phosphate crystal. Separately, test steel sheets which have been subjected to phosphate treatment are immersed in a solution of [20 g of ammonium bichromate+490 g of aqueous ammonia+490 g of water] at room temperature for 15 minutes, pulled out, and dried, and an amount of attachment of phosphate is obtained from a difference in weights before and after immersion. From the aforementioned test results, phosphate treatment property is assessed on a scale of 3-stages according to the following criteria:

◎: Phosphate crystals are attached to a whole surface without gap, and an amount of attachment of phosphate is 4 g/m$^2$ or larger.

○: Phosphate crystals are attached to an almost all region of a surface without gap, and an amount of attachment of phosphate is not smaller than 3 g/m$^2$ and smaller than 4 g/m$^2$.

x: A part to which no phosphate crystal is attached is observed in a part of a surface, and an amount of attachment of phosphate is smaller than 3 g/m$^2$.

[Alloy-Galvanizing Property]

After each test steel sheet is immersed in a melted zinc bath, alloy heat-treatment is performed at 550° C. for 60 seconds. A plated layer of the resulting alloy-galvanized steel sheet is dissolved with hydrochloric acid, and a content of Zn and that of Fe in the solution are quantitatively analyzed by ICP, whereby, the Fe concentration in alloy-galvanizing is obtained. A Fe concentration in a range of 8 to 13% is normal, and it is determined that alloying proceeds sufficiently (better), and a concentration of smaller than 8% is determined to be worse.

TABLE 1

| Steel No. | C | Si | Mn | P | S | Al | Others |
|---|---|---|---|---|---|---|---|
| 1 | 0.08 | 0.48 | 1.48 | 0.012 | 0.002 | 1.02 | |
| 2 | 0.10 | 0.49 | 1.52 | 0.013 | 0.001 | 1.03 | |
| 3 | 0.18 | 0.51 | 1.51 | 0.011 | 0.001 | 1.02 | |
| 4 | 0.25 | 0.50 | 1.51 | 0.010 | 0.002 | 0.998 | |
| 5 | 0.40 | 0.51 | 1.51 | 0.011 | 0.002 | 1.01 | |
| 6 | 0.48 | 0.52 | 1.52 | 0.011 | 0.001 | 0.999 | |
| 7 | 0.58 | 0.49 | 1.53 | 0.012 | 0.002 | 1.01 | |
| 8 | 0.20 | 0.03 | 1.49 | 0.008 | 0.001 | 1.00 | |
| 9 | 0.20 | 0.10 | 1.51 | 0.010 | 0.002 | 1.02 | |
| 3 | 0.18 | 0.51 | 1.51 | 0.011 | 0.001 | 1.02 | |
| 10 | 0.20 | 0.79 | 1.48 | 0.010 | 0.001 | 1.01 | |
| 11 | 0.20 | 1.29 | 1.50 | 0.012 | 0.002 | 0.99 | |
| 12 | 0.19 | 0.51 | 1.01 | 0.010 | 0.001 | 0.997 | |
| 3 | 0.18 | 0.51 | 1.51 | 0.011 | 0.001 | 1.02 | |
| 13 | 0.21 | 0.49 | 2.05 | 0.011 | 0.002 | 1.03 | |
| 14 | 0.20 | 0.51 | 2.51 | 0.009 | 0.002 | 1.00 | |
| 15 | 0.20 | 0.49 | 2.82 | 0.010 | 0.002 | 1.04 | |
| 3 | 0.18 | 0.51 | 1.51 | 0.011 | 0.001 | 1.02 | |
| 16 | 0.19 | 0.51 | 1.53 | 0.015 | 0.002 | 1.00 | |
| 17 | 0.21 | 0.50 | 1.52 | 0.021 | 0.002 | 1.00 | |
| 3 | 0.18 | 0.51 | 1.51 | 0.011 | 0.001 | 1.02 | |
| 18 | 0.21 | 0.52 | 1.50 | 0.009 | 0.012 | 1.03 | |
| 19 | 0.20 | 0.49 | 1.50 | 0.010 | 0.023 | 1.01 | |
| 20 | 0.19 | 0.49 | 1.49 | 0.011 | 0.030 | 1.02 | |
| 21 | 0.20 | 0.52 | 1.49 | 0.010 | 0.002 | 0.03 | |
| 22 | 0.20 | 0.51 | 1.48 | 0.011 | 0.002 | 0.34 | |
| 23 | 0.21 | 0.52 | 1.49 | 0.010 | 0.001 | 0.70 | |
| 3 | 0.18 | 0.51 | 1.51 | 0.011 | 0.001 | 1.02 | |
| 24 | 0.20 | 0.50 | 1.49 | 0.010 | 0.001 | 1.85 | |
| 25 | 0.20 | 0.49 | 1.51 | 0.010 | 0.001 | 1.01 | Nb: 0.03 |
| 26 | 0.20 | 0.51 | 1.52 | 0.011 | 0.002 | 1.03 | Mo: 0.3 |
| 27 | 0.20 | 0.52 | 1.53 | 0.010 | 0.001 | 0.998 | Cr: 0.3 |
| 28 | 0.20 | 0.51 | 1.51 | 0.012 | 0.001 | 0.999 | Ca: 20 ppm |
| 29 | 0.20 | 1.32 | 1.52 | 0.010 | 0.002 | 0.032 | |

TABLE 2

| | | Hot rolling-cooling | | | | Hot rolled-sheet | Cold rolling Rolling | | Aus-temper | Aus- |
|---|---|---|---|---|---|---|---|---|---|---|
| Experiment No. | Steel No. | SRT (° C.) | FDT (° C.) | CR1 (° C./s) | CT (° C.) | Hot rolled-microstructure | reduction rate (%) | Soaking (° C.) | temp. (° C.) | temper time (s) |
| 1 | 1 | 1200 | 880 | 50 | 400 | B | 20 | 830 | 470 | 100 |
| 2 | 2 | 1200 | 880 | 50 | 400 | B | 20 | 830 | 470 | 100 |
| 3 | 3 | 1200 | 880 | 50 | 400 | B | 20 | 830 | 470 | 100 |
| 4 | 4 | 1200 | 880 | 50 | 400 | B | 20 | 830 | 470 | 100 |
| 5 | 5 | 1200 | 880 | 50 | 400 | B | 20 | 830 | 470 | 100 |
| 6 | 6 | 1200 | 880 | 50 | 400 | B | 20 | 830 | 470 | 100 |
| 7 | 7 | 1200 | 880 | 50 | 400 | B | 20 | 830 | 470 | 100 |
| 8 | 8 | 1200 | 880 | 50 | 400 | B | 20 | 830 | 470 | 100 |
| 9 | 9 | 1200 | 880 | 50 | 400 | B | 20 | 830 | 470 | 100 |
| 3 | 3 | 1200 | 880 | 50 | 400 | B | 20 | 830 | 470 | 100 |
| 10 | 10 | 1200 | 880 | 50 | 400 | B | 20 | 830 | 470 | 100 |

TABLE 2-continued

| Experiment No. | Steel No. | Hot rolling-cooling SRT (° C.) | FDT (° C.) | CR1 (° C./s) | CT (° C.) | Hot rolled-sheet Hot rolled-microstructure | Cold rolling Rolling reduction rate (%) | Soaking (° C.) | Aus-temper temp. (° C.) | Aus-temper time (s) |
|---|---|---|---|---|---|---|---|---|---|---|
| 11 | 11 | 1200 | 880 | 50 | 400 | B | 20 | 830 | 470 | 100 |
| 12 | 12 | 1200 | 880 | 50 | 400 | B | 20 | 830 | 470 | 100 |
| 3 | 3 | 1200 | 880 | 50 | 400 | B | 20 | 830 | 470 | 100 |
| 13 | 13 | 1200 | 880 | 50 | 400 | B | 20 | 830 | 470 | 100 |
| 14 | 14 | 1200 | 880 | 50 | 400 | B | 20 | 830 | 470 | 100 |
| 15 | 15 | 1200 | 880 | 50 | 400 | B | 20 | 830 | 470 | 100 |
| 3 | 3 | 1200 | 880 | 50 | 400 | B | 20 | 830 | 470 | 100 |
| 16 | 16 | 1200 | 880 | 50 | 400 | B | 20 | 830 | 470 | 100 |
| 17 | 17 | 1200 | 880 | 50 | 400 | B | 20 | 830 | 470 | 100 |
| 3 | 3 | 1200 | 880 | 50 | 400 | B | 20 | 830 | 470 | 100 |
| 18 | 18 | 1200 | 880 | 50 | 400 | B | 20 | 830 | 470 | 100 |
| 19 | 19 | 1200 | 880 | 50 | 400 | B | 20 | 830 | 470 | 100 |
| 20 | 20 | 1200 | 880 | 50 | 400 | B | 20 | 830 | 470 | 100 |
| 21 | 21 | 1200 | 880 | 50 | 400 | B | 20 | 830 | 470 | 100 |
| 22 | 22 | 1200 | 880 | 50 | 400 | B | 20 | 830 | 470 | 100 |
| 23 | 23 | 1200 | 880 | 50 | 400 | B | 20 | 830 | 470 | 100 |
| 3 | 3 | 1200 | 880 | 50 | 400 | B | 20 | 830 | 470 | 100 |
| 24 | 24 | 1200 | 880 | 50 | 400 | B | 20 | 830 | 470 | 100 |
| 25 | 25 | 1200 | 880 | 50 | 400 | B | 20 | 830 | 470 | 100 |
| 26 | 26 | 1200 | 880 | 50 | 400 | B | 20 | 830 | 470 | 100 |
| 27 | 27 | 1200 | 880 | 50 | 400 | B | 20 | 830 | 470 | 100 |
| 28 | 28 | 1200 | 880 | 50 | 400 | B | 20 | 830 | 470 | 100 |
| 29 | 29 | 1200 | 880 | 50 | 600 | F-P | 20 | 830 | 470 | 100 |

TABLE 3

| Experiment No. | TRIP steel sheet: Microstructure (%) F | TM | TB | Others | Lath-like γ R/total γ R (%) | $C_{\gamma R}$ (%) | $f_{\gamma R}$ (%) | C (%) | $(C_{\gamma R} \times f_{\gamma R})/C$ | TS (Mpa) | EI (%) | λ (%) | Phosphoric acid treating property | Concentration of Fe in Zn |
|---|---|---|---|---|---|---|---|---|---|---|---|---|---|---|
| 1 | 0 | — | 93 | 3 | 20 | 0.66 | 4 | 0.08 | 30 | 590 | 19 | 15 | ○ | 10 |
| 2 | 0 | — | 90 | 4 | 30 | 0.75 | 6 | 0.10 | 45 | 600 | 18 | 31 | ○ | 9 |
| 3 | 0 | — | 84 | 5 | 75 | 1.06 | 11 | 0.18 | 65 | 790 | 32 | 50 | ○ | 10 |
| 4 | 0 | — | 83 | 5 | 78 | 1.31 | 12 | 0.25 | 63 | 790 | 33 | 49 | ○ | 11 |
| 5 | 0 | — | 76 | 3 | 80 | 1.33 | 21 | 0.40 | 70 | 980 | 29 | 35 | ○ | 10 |
| 6 | 0 | — | 78 | 4 | 79 | 1.28 | 28 | 0.53 | 68 | 1010 | 25 | 38 | ○ | 11 |
| 7 | 0 | — | 65 | 3 | 79 | 1.31 | 32 | 0.58 | 72 | 1310 | 20 | 35 | ○ | 11 |
| 8 | 0 | — | 86 | 3 | 80 | 1.29 | 11 | 0.20 | 71 | 785 | 33 | 51 | ◎ | 10 |
| 9 | 0 | — | 86 | 2 | 76 | 1.16 | 12 | 0.20 | 70 | 800 | 34 | 52 | ◎ | 12 |
| 3 | 0 | — | 86 | 3 | 77 | 1.06 | 11 | 0.18 | 65 | 810 | 32 | 50 | ○ | 11 |
| 10 | 0 | — | 86 | 2 | 78 | 1.06 | 10 | 0.20 | 53 | 815 | 31 | 48 | ○ | 10 |
| 11 | 0 | — | 86 | 3 | 82 | 1.05 | 11 | 0.20 | 58 | 820 | 31 | 47 | x | 0 |
| 12 | 0 | — | 84 | 3 | 79 | 1.05 | 13 | 0.18 | 72 | 730 | 35 | 61 | ○ | 11 |
| 3 | 0 | — | 86 | 3 | 82 | 1.06 | 11 | 0.18 | 65 | 790 | 32 | 50 | ○ | 10 |
| 13 | 0 | — | 84 | 2 | 83 | 1.05 | 14 | 0.21 | 70 | 810 | 30 | 45 | ○ | 11 |
| 14 | 0 | — | 84 | 3 | 80 | 1.09 | 13 | 0.20 | 71 | 980 | 27 | 39 | ○ | 12 |
| 15 | 0 | — | 83 | 3 | 82 | 1.03 | 14 | 0.20 | 72 | 995 | 28 | 36 | ○ | 10 |
| 3 | 0 | — | 86 | 3 | 83 | 1.06 | 11 | 0.18 | 65 | 790 | 32 | 50 | ○ | 10 |
| 16 | 0 | — | 86 | 2 | 84 | 1.01 | 12 | 0.19 | 64 | 810 | 31 | 59 | ○ | 11 |
| 17 | 0 | — | 84 | 3 | 85 | 1.02 | 13 | 0.21 | 63 | 820 | 31 | 48 | ○ | 12 |
| 3 | 0 | — | 86 | 3 | 80 | 1.06 | 11 | 0.18 | 65 | 790 | 32 | 50 | ○ | 10 |
| 18 | 0 | — | 87 | 2 | 77 | 1.30 | 11 | 0.21 | 68 | 785 | 33 | 48 | ○ | 12 |
| 19 | 0 | — | 86 | 2 | 79 | 1.15 | 12 | 0.20 | 69 | 790 | 32 | 44 | ○ | 11 |
| 20 | 0 | — | 86 | 3 | 74 | 1.16 | 11 | 0.19 | 67 | 787 | 31 | 43 | ○ | 11 |
| 21 | 0 | — | 95 | 3 | — | — | 2 | 0.20 | — | 795 | 25 | 30 | ○ | 10 |
| 22 | 0 | — | 95 | 3 | — | — | 2 | 0.20 | — | 794 | 23 | 39 | ○ | 10 |
| 23 | 0 | — | 87 | 3 | 74 | 1.45 | 10 | 0.21 | 69 | 793 | 30 | 45 | ○ | 11 |
| 3 | 0 | — | 86 | 3 | 78 | 1.06 | 11 | 0.18 | 65 | 790 | 32 | 50 | ○ | 12 |
| 24 | 0 | — | 83 | 3 | 74 | 0.98 | 14 | 0.20 | 69 | 794 | 33 | 59 | ○ | 12 |
| 25 | 0 | — | 83 | 3 | 81 | 1.04 | 14 | 0.20 | 73 | 980 | 23 | 45 | ○ | 11 |
| 26 | 0 | — | 82 | 4 | 82 | 1.03 | 14 | 0.20 | 72 | 990 | 28 | 48 | ○ | 12 |
| 27 | 0 | — | 85 | 2 | 80 | 1.12 | 13 | 0.20 | 73 | 985 | 29 | 49 | ○ | 10 |
| 28 | 0 | — | 83 | 3 | 81 | 1.03 | 14 | 0.20 | 72 | 790 | 30 | 48 | ○ | 10 |
| 29 | 0 | — | — | 14 | 25 | 0.66 | 12 | 0.2 | 40 | 790 | 27 | 23 | x | 3 |

TABLE 4

| Experiment No. | Steel No. | Hot rolling-cooling SRT (° C.) | FDT (° C.) | CR1 (° C./s) | CTN (° C.) | CR2 (° C./s) | CT (° C.) | Hot rolled-sheet Hot rolled-microstructure | Cold rolling Rolling reduction rate (%) | Soaking (° C.) | Aus-temper temp. (° C.) | Aus-temper time (s) |
|---|---|---|---|---|---|---|---|---|---|---|---|---|
| 30 | 3 | 1200 | 880 | 50 | — | — | 400 | B | 20 | 700 | 470 | 100 |
| 31 | 3 | 1200 | 880 | 50 | — | — | 400 | B | 20 | 800 | 470 | 100 |
| 32 | 3 | 1200 | 880 | 50 | — | — | 400 | B | 20 | 830 | 470 | 100 |
| 33 | 3 | 1200 | 880 | 50 | — | — | 400 | B | 20 | 860 | 470 | 100 |
| 34 | 3 | 1200 | 880 | 50 | — | — | 400 | B | 20 | 900 | 470 | 100 |
| 35 | 3 | 1200 | 880 | 50 | — | — | 400 | B | 20 | 830 | 470 | 100 |
| 36 | 3 | 1200 | 880 | 50 | — | — | 400 | B | 20 | 830 | 430 | 100 |
| 37 | 3 | 1200 | 880 | 50 | — | — | 400 | B | 20 | 830 | 470 | 100 |
| 38 | 3 | 1200 | 880 | 50 | — | — | 400 | B | 20 | 830 | 500 | 100 |
| 39 | 3 | 1200 | 880 | 50 | — | — | 400 | B | 20 | 830 | 530 | 100 |
| 40 | 3 | 1200 | 880 | 50 | — | — | 400 | B | 20 | 830 | 560 | 100 |
| 41 | 3 | 1200 | 880 | 50 | 800 | 50 | 100 | M | 20 | 830 | 470 | 100 |
| 42 | 3 | 1200 | 880 | 50 | 700 | 50 | 100 | F-M | 20 | 830 | 470 | 100 |
| 43 | 3 | 1200 | 880 | 50 | 600 | 50 | 100 | F-M | 20 | 830 | 470 | 100 |
| 44 | 3 | 1200 | 880 | 50 | 800 | 50 | 400 | B | 20 | 830 | 470 | 100 |
| 45 | 3 | 1200 | 880 | 50 | 700 | 50 | 400 | F-B | 20 | 830 | 470 | 100 |
| 46 | 3 | 1200 | 880 | 50 | 600 | 50 | 400 | F-B | 20 | 830 | 470 | 100 |
| 47 | 8 | 1200 | 880 | 50 | — | — | 400 | B | 20 | 830 | 400 | 100 |
| 48 | 8 | 1200 | 880 | 50 | — | — | 400 | B | 20 | 830 | 430 | 100 |
| 49 | 8 | 1200 | 880 | 50 | — | — | 400 | B | 20 | 830 | 470 | 100 |
| 50 | 8 | 1200 | 880 | 50 | — | — | 400 | B | 20 | 830 | 500 | 100 |
| 51 | 8 | 1200 | 880 | 50 | — | — | 400 | B | 20 | 830 | 530 | 100 |
| 52 | 8 | 1200 | 880 | 50 | — | — | 400 | B | 20 | 830 | 560 | 100 |

TABLE 5

| Experiment No. | TRIP steel sheet: Microstructure (%) F | TM | TB | Others | Lath-like γ R/total γ R (%) | $C_{\gamma R}$ (%) | $f_{\gamma R}$ (%) | C (%) | $(C_{\gamma R} \times f_{\gamma R})/C$ | TS (Mpa) | EI (%) | λ (%) | Phosphoric acid treating property | Concentration of Fe in Zn |
|---|---|---|---|---|---|---|---|---|---|---|---|---|---|---|
| 30 | — | — | 95 | 3 | 77 | 0.90 | 2 | 0.18 | 10 | 800 | 20 | 30 | ◎ | 11 |
| 31 | — | — | 86 | 4 | 79 | 1.21 | 10 | 0.18 | 67 | 800 | 31 | 45 | ◎ | 12 |
| 32 | — | — | 83 | 4 | 80 | 0.90 | 13 | 0.18 | 65 | 790 | 32 | 55 | ◎ | 10 |
| 33 | — | — | 84 | 3 | 73 | 0.90 | 13 | 0.18 | 65 | 795 | 32 | 50 | ◎ | 11 |
| 34 | — | — | 88 | 4 | 74 | 1.12 | 9 | 0.18 | 56 | 790 | 30 | 30 | ◎ | 12 |
| 35 | — | — | 89 | 3 | 75 | 0.90 | 8 | 0.18 | 40 | 805 | 20 | 30 | ◎ | 11 |
| 36 | — | — | 90 | 3 | 80 | 0.90 | 7 | 0.18 | 35 | 800 | 21 | 32 | ◎ | 10 |
| 37 | — | — | 83 | 4 | 82 | 1.23 | 13 | 0.18 | 93 | 795 | 27 | 55 | ◎ | 9 |
| 38 | — | — | 81 | 4 | 81 | 1.29 | 15 | 0.18 | 108 | 799 | 32 | 50 | ◎ | 10 |
| 39 | — | — | 87 | 3 | 79 | 1.10 | 10 | 0.18 | 61 | 795 | 33 | 53 | ◎ | 11 |
| 40 | — | — | 89 | 3 | 74 | 0.79 | 8 | 0.18 | 35 | 790 | 30 | 28 | ◎ | 10 |
| 41 | 0 | 84 | — | 4 | 77 | 1.10 | 12 | 0.18 | 73 | 795 | 30 | 40 | ◎ | 9 |
| 42 | 37 | 46 | — | 4 | 78 | 1.11 | 13 | 0.18 | 80 | 790 | 32 | 48 | ◎ | 9 |
| 43 | 40 | 48 | — | 3 | 82 | 1.05 | 12 | 0.18 | 70 | 800 | 33 | 40 | ◎ | 10 |
| 44 | 0 | — | 83 | 3 | 83 | 1.05 | 14 | 0.18 | 81 | 800 | 30 | 48 | ◎ | 10 |
| 45 | 43 | — | 41 | 4 | 81 | 1.02 | 12 | 0.18 | 68 | 790 | 29 | 40 | ◎ | 10 |
| 46 | 40 | — | 43 | 4 | 82 | 0.98 | 13 | 0.18 | 71 | 795 | 30 | 45 | ◎ | 11 |
| 47 | — | — | 92 | 3 | 79 | 1.44 | 5 | 0.20 | 36 | 790 | 20 | 30 | ◎ | 10 |
| 48 | — | — | 87 | 3 | 78 | 1.08 | 10 | 0.20 | 54 | 799 | 20 | 27 | ◎ | 9 |
| 49 | — | — | 84 | 3 | 77 | 1.00 | 13 | 0.20 | 65 | 800 | 27 | 55 | ◎ | 9 |
| 50 | — | — | 80 | 4 | 79 | 1.12 | 16 | 0.20 | 89 | 795 | 32 | 56 | ◎ | 10 |
| 51 | — | — | 84 | 4 | 80 | 1.22 | 10 | 0.20 | 61 | 800 | 31 | 50 | ◎ | 10 |
| 52 | — | — | 83 | 3 | 82 | 0.90 | 4 | 0.20 | 18 | 800 | 27 | 25 | ◎ | 10 |

TABLE 6

| Experiment No. | Steel No. | Hot rolling-cooling SRT (° C.) | FDT (° C.) | CR1 (° C./s) | CTN (° C.) | CR2 (° C./s) | CT (° C.) | Hot rolled-sheet Hot rolled microstructure | Cold rolling Rolling reduction rate (%) | Soaking (° C.) | Aus-temper temp. (° C.) | Aus-temper time (s) |
|---|---|---|---|---|---|---|---|---|---|---|---|---|
| 53 | 8 | 1200 | 880 | 50 | — | — | 400 | B | 20 | 830 | 470 | 5 |
| 54 | 8 | 1200 | 880 | 50 | — | — | 400 | B | 20 | 830 | 470 | 20 |
| 55 | 8 | 1200 | 880 | 50 | — | — | 400 | B | 20 | 830 | 470 | 50 |
| 56 | 8 | 1200 | 880 | 50 | — | — | 400 | B | 20 | 830 | 470 | 100 |
| 57 | 8 | 1200 | 880 | 50 | — | — | 400 | B | 20 | 830 | 470 | 300 |
| 58 | 8 | 1200 | 880 | 50 | — | — | 400 | B | 20 | 830 | 470 | 900 |
| 59 | 29 | 1200 | 880 | 50 | — | — | 400 | B | 70 | 830 | 370 | 100 |
| 60 | 29 | 1200 | 880 | 50 | — | — | 400 | B | 70 | 830 | 400 | 100 |
| 61 | 29 | 1200 | 880 | 50 | — | — | 400 | B | 70 | 830 | 430 | 100 |
| 62 | 29 | 1200 | 880 | 50 | — | — | 400 | B | 70 | 830 | 470 | 100 |
| 63 | 29 | 1200 | 880 | 50 | — | — | 400 | B | 70 | 830 | 500 | 100 |
| 64 | 29 | 1200 | 880 | 50 | — | — | 400 | B | 70 | 830 | 530 | 100 |
| 65 | 29 | 1200 | 880 | 50 | — | — | 400 | B | 70 | 830 | 560 | 100 |
| 66 | 3 | 1200 | 880 | 50 | 700 | 50 | 100 | F-M | 0 | 830 | 470 | 100 |
| 67 | 3 | 1200 | 880 | 50 | 700 | 50 | 100 | F-M | 10 | 830 | 470 | 100 |
| 68 | 3 | 1200 | 880 | 50 | 700 | 50 | 100 | F-M | 20 | 830 | 470 | 100 |
| 69 | 3 | 1200 | 880 | 50 | 700 | 50 | 100 | F-M | 30 | 830 | 470 | 100 |
| 70 | 3 | 1200 | 880 | 50 | 700 | 50 | 100 | F-M | 40 | 830 | 470 | 100 |

TABLE 7

| Experiment No. | TRIP steel sheet Microstructure (%) F | TM | TB | Others | Lath-like γ R/total γ R (%) | $C_{\gamma R}$ (%) | $f_{\gamma R}$ (%) | C (%) | $(C_{\gamma R} \times f_{\gamma R})/C$ | TS (Mpa) | EI (%) | λ (%) | Phosphoric acid treating property | Concentration of Fe in Zn |
|---|---|---|---|---|---|---|---|---|---|---|---|---|---|---|
| 53 | — | — | 84 | 3 | 81 | 1.20 | 3 | 0.20 | 18 | 799 | 18 | 25 | ◎ | 10 |
| 54 | — | — | 77 | 3 | 82 | 1.10 | 10 | 0.20 | 55 | 790 | 23 | 35 | ◎ | 10 |
| 55 | — | — | 85 | 4 | 83 | 1.09 | 11 | 0.20 | 60 | 795 | 30 | 45 | ◎ | 10 |
| 56 | — | — | 83 | 4 | 79 | 1.00 | 13 | 0.20 | 65 | 800 | 32 | 55 | ◎ | 11 |
| 57 | — | — | 85 | 3 | 78 | 1.13 | 12 | 0.20 | 68 | 800 | 30 | 50 | ◎ | 10 |
| 58 | — | — | 90 | 4 | 77 | 1.20 | 6 | 0.20 | 36 | 800 | 15 | 25 | ◎ | 10 |
| 59 | — | — | 86 | 4 | 21 | 0.86 | 10 | 0.20 | 43 | 790 | 30 | 23 | ◎ | 1 |
| 60 | — | — | 83 | 3 | 30 | 1.10 | 14 | 0.20 | 77 | 790 | 32 | 24 | ◎ | 2 |
| 61 | — | — | 83 | 4 | 28 | 1.11 | 13 | 0.20 | 72 | 799 | 27 | 22 | ◎ | 3 |
| 62 | — | — | 87 | 3 | 30 | 0.91 | 10 | 0.20 | 45 | 800 | 23 | 21 | ◎ | 2 |
| 63 | — | — | 88 | 3 | 31 | 0.89 | 9 | 0.20 | 41 | 795 | 19 | 23 | ◎ | 1 |
| 64 | — | — | 90 | 3 | 33 | 0.90 | 7 | 0.20 | 31 | 800 | 17 | 20 | ◎ | 2 |
| 65 | — | — | 92 | 4 | 34 | 0.90 | 4 | 0.20 | 18 | 800 | 15 | 21 | ◎ | 1 |
| 66 | 45 | 37 | — | 3 | 83 | 1.21 | 15 | 0.20 | 91 | 795 | 30 | 48 | ◎ | 11 |
| 67 | 44 | 40 | — | 3 | 83 | 1.11 | 13 | 0.20 | 72 | 790 | 32 | 48 | ◎ | 12 |
| 68 | 49 | 33 | — | 4 | 79 | 1.11 | 14 | 0.20 | 78 | 800 | 30 | 38 | ◎ | 13 |
| 69 | 40 | 42 | — | 4 | 79 | 1.00 | 14 | 0.20 | 70 | 795 | 31 | 36 | ◎ | 12 |
| 70 | 49 | 34 | — | 4 | 33 | 1.00 | 13 | 0.20 | 65 | 790 | 25 | 20 | ◎ | 10 |

As apparent from FIG. 3, in a conventional type comparative steel sheet having an Al content of 0.03% by mass, as an austempering temperature after soaking grows higher, a value obtained from the equation (I) is decreased approximately linearly, while for inventive steel materials having an Al content exceeding 0.3% by mass as defined in the present invention, a peculiar tendency is exhibited that a value of the equation (I) shows a peak in a region of an austemper temperature of 450 to 550° C. In addition, from FIG. 4, a value of the equation (I) shows a peak at an austemper time between 10 and 500 seconds. And, it is confirmed that a steel sheet adopting such an austemper temperature and austemper time for getting a high value as a value of the equation (I), has values which are stable at a high level in the tensile strength (TS), the total elongation (EL) and the hole enlarging rate (λ).

A tendency confirmed by the aforementioned FIGS. 3 and 4 is almost the same in a relationship between an amount of retained austenite, an austemper temperature and an austemper time shown in FIGS. 5 and 6, and it is seen that in the present invention using a steel material having a relatively high Al content, by setting the retaining temperature at 450 to 550° C. and the austemper time at 10 to 500 seconds, an amount of retained austenite of 5% by volume or larger can be obtained.

Example 2

A test steel having a component composition described in the following Table 8 (unit is % by mass in Table) was melted in vacuum and produced into an experimental slab having a thickness of 20 to 30 mm and, thereafter, manufactured into a hot rolled-sheet having a sheet thickness of 2.5 mm by a hot rolling-1 stage (monotonous) cooling pattern and further cold rolled to manufacture a cold rolled sheet having a sheet thickness of 2.0 mm. This cold rolled sheet was heated to a ferrite-austenite 2 phase region temperature (930° C.), soaked by retaining for 120 seconds, and subjected to a cooling process, a temperature retaining process and a continuous annealing process by an air cooling as shown in FIG. 7 to get a cold rolled steel sheet.

Figure 7:
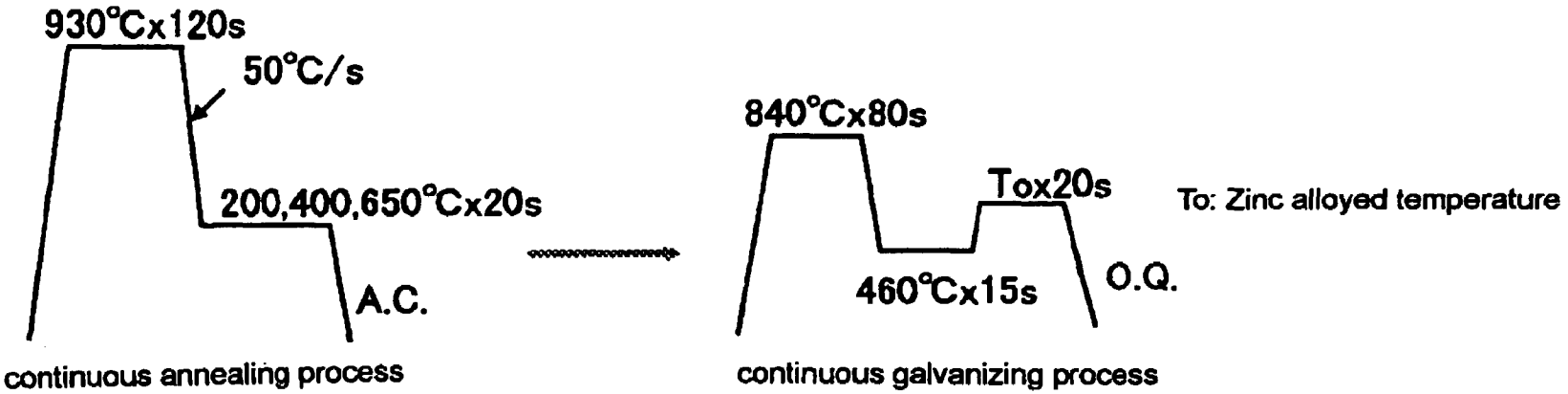
FIG. 7 is a graph showing a change of temperature in a continuous annealing process and a continuous galvanizing process.

After each cold rolled steel sheet is retained at 840° C. for 80 seconds and immersed and traveled in a melt zinc bath, an alloy treatment is performed at a predetermined temperature $T_0$ for a predetermined time to get an alloy-galvanized steel sheet as shown in FIG. 7. All the conditions are shown in Tables 9 and 10.

The microstructure of the resulting each galvanized steel sheet was observed as shown in Example 1. An area rate of each of tempered martensite, tempered bainite and ferrite and also a ratio of lath-like retained austenite relative to total retained austenite was also measured. On the other hand, a volume rate of retained austenite and a C concentration in retained austenite was measured. The results are totally shown in Table 11.

A tensile strength (TS), a total elongation (E1) and a hole enlarging rate (λ) were measured and phosphoric acid treating property and Fe concentration in galvanizing were obtained, in the same way as Example 1. The results are totally shown in Table 12.

TABLE 8

| Steel No. | C | Si | Mn | P | S | Al |
|---|---|---|---|---|---|---|
| 30 | 0.20 | 0.03 | 2.3 | 0.01 | 0.001 | 1.5 |
| 31 | 0.20 | 0.03 | 2.5 | 0.01 | 0.001 | 1.5 |

TABLE 9

| | | Hot Process | | | | | Cold | CAL Process | | | | CGL Process | | |
|---|---|---|---|---|---|---|---|---|---|---|---|---|---|---|
| | | Hot rolling-cooling | | | | Hot rolled- | rolling Rolling | | Aus-temper | Aus-temper | Annealed | | Aus-temper | Aus- |
| Experiment No. | Steel No. | SRT (° C.) | FDT (° C.) | CR (° C./s) | CT (° C.) | micro-structure | reduction rate (%) | Soaking (° C.) | temp. (° C.) | time (s) | micro-structure | Soaking (° C.) | temp. (To) (° C.) | temper time (s) |
| 71 | 30 | 1200 | 880 | 50 | 650 | F-P | 0 | — | — | — | — | 840 | 550 | 20 |
| 72 | 30 | 1200 | 880 | 80 | 400 | B | 0 | — | — | — | — | 840 | 550 | 20 |
| 73 | 30 | 1200 | 880 | 100 | 200 | M | 0 | — | — | — | — | 840 | 550 | 20 |
| 74 | 30 | 1200 | 880 | 50 | 650 | F-P | 60 | 930 | 200 | 20 | M | 840 | 400 | 20 |
| 75 | 30 | 1200 | 880 | 50 | 650 | F-P | 60 | 930 | 200 | 20 | M | 840 | 430 | 20 |
| 76 | 30 | 1200 | 880 | 50 | 650 | F-P | 60 | 930 | 200 | 20 | M | 840 | 460 | 20 |
| 77 | 30 | 1200 | 880 | 50 | 650 | F-P | 60 | 930 | 200 | 20 | M | 840 | 490 | 20 |
| 78 | 30 | 1200 | 880 | 50 | 650 | F-P | 60 | 930 | 200 | 20 | M | 840 | 520 | 20 |
| 79 | 30 | 1200 | 880 | 50 | 650 | F-P | 60 | 930 | 200 | 20 | M | 840 | 550 | 20 |
| 80 | 30 | 1200 | 880 | 50 | 650 | F-P | 60 | 930 | 200 | 20 | M | 840 | 580 | 20 |
| 81 | 30 | 1200 | 880 | 50 | 650 | F-P | 60 | 930 | 200 | 20 | M | 840 | 550 | 5 |
| 82 | 30 | 1200 | 880 | 50 | 650 | F-P | 60 | 930 | 200 | 20 | M | 840 | 550 | 10 |
| 83 | 30 | 1200 | 880 | 50 | 650 | F-P | 60 | 930 | 200 | 20 | M | 840 | 550 | 60 |
| 84 | 31 | 1200 | 880 | 50 | 650 | F-P | 60 | 930 | 200 | 20 | B | 840 | 400 | 20 |
| 85 | 31 | 1200 | 880 | 50 | 650 | F-P | 60 | 930 | 200 | 20 | B | 840 | 430 | 20 |
| 86 | 31 | 1200 | 880 | 50 | 650 | F-P | 60 | 930 | 200 | 20 | B | 840 | 460 | 20 |
| 87 | 31 | 1200 | 880 | 50 | 650 | F-P | 60 | 930 | 200 | 20 | B | 840 | 490 | 20 |
| 88 | 31 | 1200 | 880 | 50 | 650 | F-P | 60 | 930 | 200 | 20 | B | 840 | 520 | 20 |
| 89 | 31 | 1200 | 880 | 50 | 650 | F-P | 60 | 930 | 200 | 20 | B | 840 | 550 | 20 |
| 90 | 31 | 1200 | 880 | 50 | 650 | F-P | 60 | 930 | 200 | 20 | B | 840 | 580 | 20 |
| 91 | 31 | 1200 | 880 | 50 | 650 | F-P | 60 | 930 | 200 | 20 | B | 840 | 550 | 5 |
| 92 | 31 | 1200 | 880 | 50 | 650 | F-P | 60 | 930 | 200 | 20 | B | 840 | 550 | 10 |
| 93 | 31 | 1200 | 880 | 50 | 650 | F-P | 60 | 930 | 200 | 20 | B | 840 | 550 | 60 |

TABLE 10

| | | Hot Process | | | | | Cold | CAL Process | | | | CGL Process | | |
|---|---|---|---|---|---|---|---|---|---|---|---|---|---|---|
| | | Hot rolling-cooling | | | | Hot rolled- | rolling Rolling | | Aus-temper | Aus-temper | Annealed | | Aus-temper | Aus-temper |
| Experiment No. | Steel No. | SRT (° C.) | FDT (° C.) | CR (° C./s) | CT (° C.) | micro-structure | reduction rate (%) | Soaking (° C.) | temp. (° C.) | time (s) | micro-structure | Soaking (° C.) | temp. (To) (° C.) | time (s) |
| 94 | 30 | 1200 | 880 | 50 | 650 | F-P | 60 | 930 | 400 | 20 | B | 840 | 400 | 20 |
| 95 | 30 | " | " | " | " | " | " | " | " | " | " | " | 430 | " |
| 96 | 30 | " | " | " | " | " | " | " | " | " | " | " | 460 | " |
| 97 | 30 | " | " | " | " | " | " | " | " | " | " | " | 490 | " |
| 98 | 30 | " | " | " | " | " | " | " | " | " | " | " | 520 | " |
| 99 | 30 | " | " | " | " | " | " | " | " | " | " | " | 550 | " |
| 100 | 30 | " | " | " | " | " | " | " | " | " | " | " | 580 | " |
| 101 | 30 | " | " | " | " | " | " | " | " | " | " | " | 550 | 5 |
| 102 | 30 | " | " | " | " | " | " | " | " | " | " | " | 550 | 10 |
| 103 | 30 | " | " | " | " | " | " | " | " | " | " | " | 550 | 60 |
| 104 | 30 | 1200 | 880 | 50 | 650 | F-P | 60 | 930 | 650 | 20 | F-P | 840 | 400 | 20 |

TABLE 10-continued

| | | Hot Process | | | | | Cold | CAL Process | | | | CGL Process | | |
|---|---|---|---|---|---|---|---|---|---|---|---|---|---|---|
| | | Hot rolling-cooling | | | | Hot rolled- | rolling Rolling | | Aus- | Aus- | Annealed | | Aus- | Aus- |
| Experiment No. | Steel No. | SRT (° C.) | FDT (° C.) | CR (° C./s) | CT (° C.) | micro-structure | reduction rate (%) | Soaking (° C.) | temp. (° C.) | temp. time (s) | micro-structure | Soaking (° C.) | temp. (To) (° C.) | temp. time (s) |
| 105 | 30 | " | " | " | " | " | " | " | " | " | " | " | 430 | " |
| 106 | 30 | " | " | " | " | " | " | " | " | " | " | " | 460 | " |
| 107 | 30 | " | " | " | " | " | " | " | " | " | " | " | 490 | " |
| 108 | 30 | " | " | " | " | " | " | " | " | " | " | " | 520 | " |
| 109 | 30 | " | " | " | " | " | " | " | " | " | " | " | 550 | " |
| 110 | 30 | " | " | " | " | " | " | " | " | " | " | " | 580 | " |

TABLE 11

| | | Microstructure | | | | | | | |
|---|---|---|---|---|---|---|---|---|---|
| | | | | | | Lath-like γ | retained γ property | | |
| Experiment No. | Steel No. | F | TM | TB | Others | R/total γ R (%) | $C_{\gamma R}$ (%) | $f_{\gamma R}$ (%) | $(C_{\gamma R} \times f_{\gamma R})/C$ |
| 71 | 30 | 40 | — | — | 3 | 40 | 1.0 | 9 | 45 |
| 72 | 30 | — | — | 83 | 4 | 80 | 1.2 | 13 | 78 |
| 73 | 30 | — | 78 | — | 3 | 73 | 1.3 | 14 | 91 |
| 74 | 30 | 2 | 80 | — | 2 | 81 | 1.3 | 11 | 72 |
| 75 | 30 | 3 | 83 | — | 3 | 78 | 1.2 | 12 | 72 |
| 76 | 30 | 1 | 79 | — | 2 | 79 | 1.3 | 15 | 98 |
| 77 | 30 | 2 | 81 | — | 3 | 78 | 1.3 | 15 | 98 |
| 78 | 30 | 2 | 79 | — | 1 | 77 | 1.3 | 15 | 98 |
| 79 | 30 | 3 | 80 | — | 2 | 76 | 1.3 | 14 | 91 |
| 80 | 30 | 1 | 81 | — | 3 | 79 | 1.4 | 13 | 91 |
| 81 | 30 | 2 | 82 | — | 2 | 80 | 0.8 | 11 | 44 |
| 82 | 30 | 2 | 81 | — | 1 | 81 | 1.4 | 13 | 91 |
| 79 | 30 | 3 | 80 | — | 2 | 76 | 1.3 | 14 | 91 |
| 83 | 30 | 1 | 84 | — | 2 | 81 | 1.3 | 12 | 78 |
| 84 | 31 | 2 | 78 | — | 2 | 78 | 1.2 | 11 | 66 |
| 85 | 31 | 3 | 81 | — | 3 | 77 | 1.1 | 12 | 66 |
| 86 | 31 | 5 | 79 | — | 2 | 76 | 1.2 | 13 | 78 |
| 87 | 31 | 0 | 80 | — | 2 | 78 | 1.3 | 13 | 85 |
| 88 | 31 | 3 | 81 | — | 3 | 79 | 1.2 | 13 | 78 |
| 89 | 31 | 2 | 80 | — | 2 | 76 | 1.1 | 13 | 72 |
| 90 | 31 | 4 | 80 | — | 1 | 75 | 1.2 | 14 | 84 |
| 91 | 31 | 0 | 78 | — | 2 | 78 | 0.8 | 11 | 44 |
| 92 | 31 | 3 | 79 | — | 3 | 76 | 1.3 | 12 | 78 |
| 89 | 31 | 2 | 80 | — | 2 | 76 | 1.1 | 13 | 72 |
| 93 | 31 | 2 | 80 | — | 4 | 77 | 1.4 | 12 | 84 |
| 94 | 30 | 2 | — | 80 | 2 | 70 | 1.1 | 12 | 66 |
| 95 | 30 | 3 | — | 79 | 3 | 68 | 1.2 | 11 | 66 |
| 96 | 30 | 2 | — | 78 | 2 | 67 | 1.2 | 13 | 78 |
| 97 | 30 | 2 | — | 81 | 3 | 70 | 1.2 | 14 | 84 |
| 98 | 30 | 2 | — | 79 | 4 | 71 | 1.3 | 12 | 78 |
| 99 | 30 | 1 | — | 78 | 3 | 69 | 1.4 | 11 | 77 |
| 100 | 30 | 0 | — | 77 | 2 | 68 | 1.3 | 13 | 85 |
| 101 | 30 | 1 | — | 79 | 1 | 67 | 0.8 | 12 | 48 |
| 102 | 30 | 2 | — | 80 | 3 | 66 | 1.2 | 11 | 66 |
| 99 | 30 | 1 | — | 78 | 3 | 69 | 1.4 | 11 | 77 |
| 103 | 30 | 3 | — | 76 | 2 | 68 | 1.3 | 12 | 78 |
| 104 | 30 | 2 | — | 77 | 1 | 40 | 1.2 | 11 | 66 |
| 105 | 30 | 3 | — | 76 | 2 | 38 | 1.1 | 12 | 66 |
| 106 | 30 | 1 | — | 78 | 3 | 47 | 1.1 | 8 | 44 |
| 107 | 30 | 0 | — | 77 | 2 | 38 | 1.0 | 9 | 45 |
| 108 | 30 | 2 | — | 76 | 1 | 37 | 1.1 | 7 | 39 |
| 109 | 30 | 1 | — | 75 | 2 | 33 | 1.0 | 7 | 35 |
| 110 | 30 | 1 | — | 73 | 2 | 25 | 1.0 | 6 | 30 |

TABLE 12

| | | mechanical property | | | Surface property | | |
|---|---|---|---|---|---|---|---|
| Experiment No. | Steel No. | TS (MPa) | El (%) | γ (%) | Phosphoric acid treating property | Concentration of Fe in Zn | Total valuation |
| 71 | 30 | 801 | 20 | 18 | ◎ | 12 | X |
| 72 | 30 | 802 | 28 | 30 | ◎ | 11 | ◎ |
| 73 | 30 | 804 | 26 | 25 | ◎ | 13 | ◎ |
| 74 | 30 | 803 | 28 | 37 | ◎ | 2 | X |
| 75 | 30 | 802 | 29 | 32 | ◎ | 4 | X |
| 76 | 30 | 801 | 28 | 30 | ◎ | 9 | ○ |
| 77 | 30 | 800 | 25 | 28 | ◎ | 12 | ○ |
| 78 | 30 | 804 | 26 | 27 | ◎ | 11 | ◎ |
| 79 | 30 | 798 | 26 | 27 | ◎ | 10 | ◎ |
| 80 | 30 | 803 | 25 | 26 | ◎ | 11 | ◎ |
| 81 | 30 | 890 | 22 | 17 | ◎ | 6 | X |
| 82 | 30 | 801 | 23 | 26 | ◎ | 11 | ◎ |
| 79 | 30 | 798 | 26 | 27 | ◎ | 12 | ◎ |
| 83 | 30 | 802 | 25 | 28 | ◎ | 11 | ◎ |
| 84 | 31 | 810 | 28 | 36 | ◎ | 2 | X |
| 85 | 31 | 808 | 29 | 32 | ◎ | 3 | X |
| 86 | 31 | 812 | 28 | 30 | ◎ | 9 | ◎ |
| 87 | 31 | 890 | 27 | 28 | ◎ | 12 | ◎ |
| 88 | 31 | 810 | 25 | 27 | ◎ | 11 | ◎ |
| 89 | 31 | 790 | 27 | 27 | ◎ | 13 | ◎ |
| 90 | 31 | 790 | 26 | 26 | ◎ | 12 | ◎ |
| 91 | 31 | 880 | 22 | 18 | ◎ | 13 | X |
| 92 | 31 | 803 | 26 | 27 | ◎ | 11 | ◎ |
| 89 | 31 | 790 | 27 | 27 | ◎ | 12 | ◎ |
| 93 | 31 | 802 | 27 | 28 | ◎ | 11 | ◎ |
| 94 | 30 | 790 | 29 | 30 | ◎ | 3 | X |
| 95 | 30 | 770 | 30 | 30 | ◎ | 4 | X |
| 96 | 30 | 790 | 30 | 25 | ◎ | 9 | ◎ |
| 97 | 30 | 820 | 27 | 24 | ◎ | 12 | ◎ |
| 98 | 30 | 820 | 28 | 25 | ◎ | 11 | ◎ |
| 99 | 30 | 820 | 27 | 24 | ◎ | 13 | ◎ |
| 100 | 30 | 800 | 27 | 28 | ◎ | 12 | ◎ |
| 101 | 30 | 870 | 22 | 18 | ◎ | 14 | X |
| 102 | 30 | 800 | 27 | 26 | ◎ | 12 | ◎ |
| 99 | 30 | 820 | 27 | 24 | ◎ | 11 | ◎ |
| 103 | 30 | 802 | 28 | 28 | ◎ | 12 | ◎ |
| 104 | 30 | 802 | 25 | 23 | ◎ | 2 | X |
| 105 | 30 | 798 | 26 | 23 | ◎ | 5 | X |
| 106 | 30 | 808 | 26 | 21 | ◎ | 9 | X |
| 107 | 30 | 805 | 24 | 20 | ◎ | 12 | X |
| 108 | 30 | 811 | 23 | 18 | ◎ | 11 | X |
| 109 | 30 | 812 | 22 | 20 | ◎ | 13 | X |
| 110 | 30 | 800 | 24 | 24 | ◎ | 12 | X |

Figure 8:
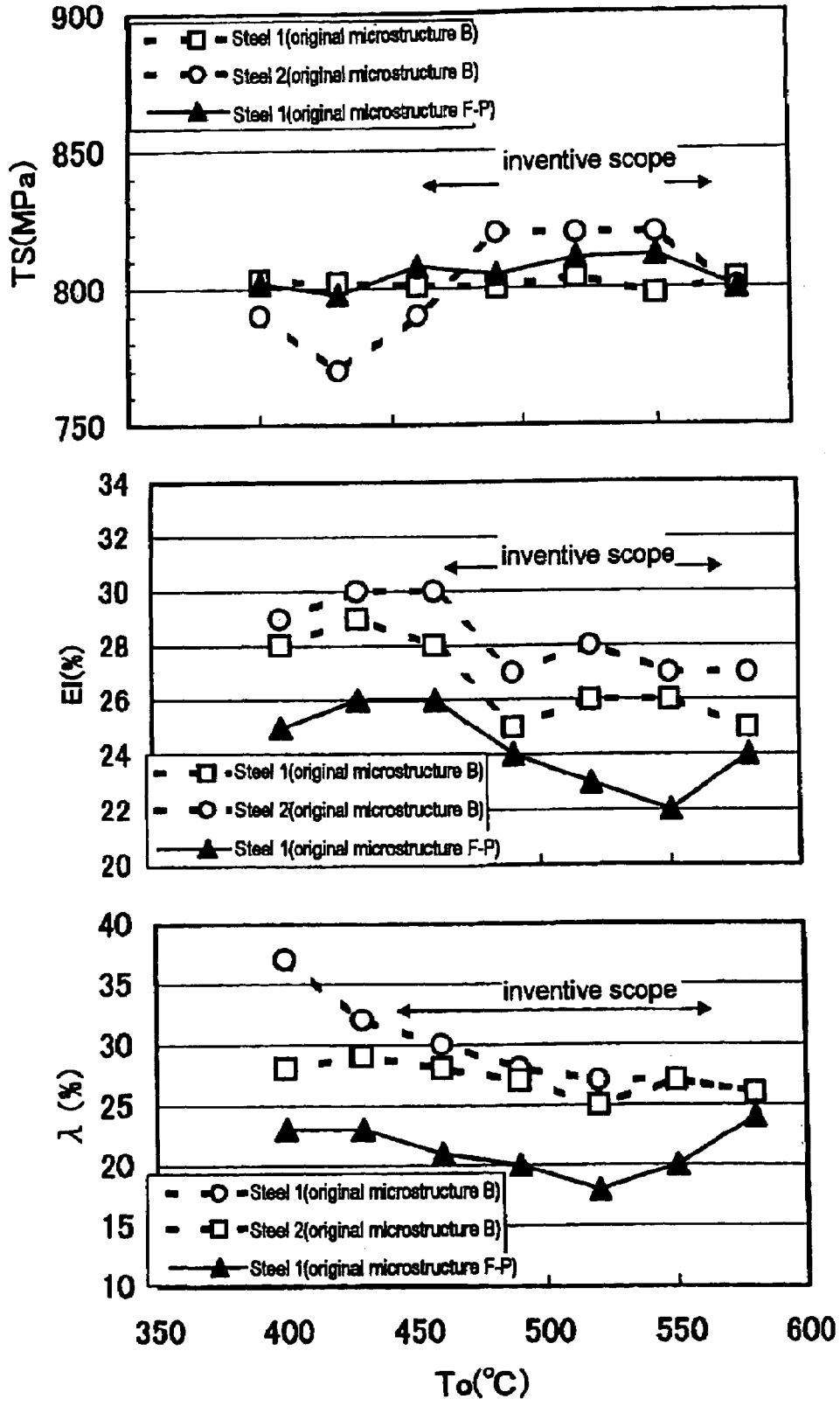
FIG. 8 is a graph showing changes of the tensile strength (TS), the total elongation (EL) and the hole enlarging rate (λ).depending on the alloy heat treatment temperature T ° C.).
Figure 9:
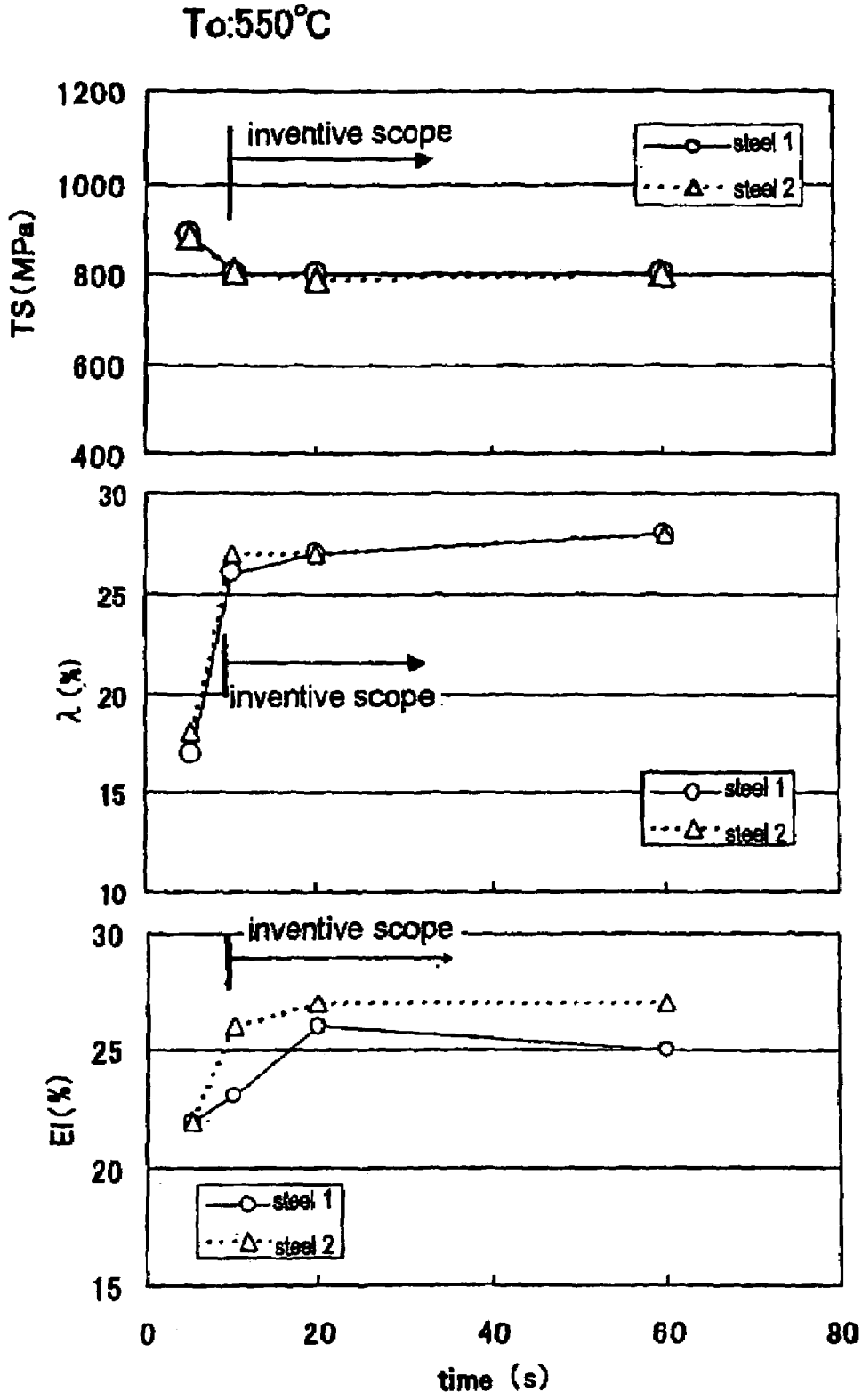
FIG. 9 is a graph showing changes of the tensile strength (TS), the total elongation (EL) and the hole enlarging rate (λ).depending on the alloy heat treatment time at 550° C.
Figure 10:
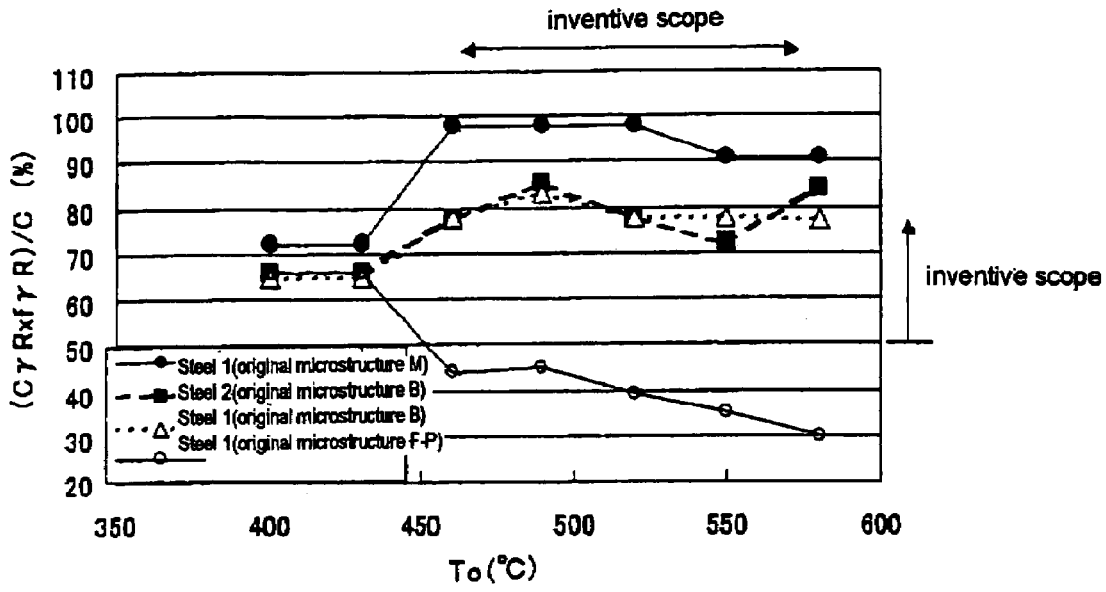
FIG. 10 is a graph showing the retained γ property of the microstructure depending on the alloy heat treatment temperature (T ° C.).

FIGS. 8, 9 and 10 were made from the results of Tables 7 to 11 and show the relation (FIG. 10) between the retained γ property and the alloy heat treatment temperature of alloy-galvanized steel sheet which causes the mechanical properties of a tensile strength (TS) and a total elongation (E1) and a hole enlarging rate (λ).

From these FIGS. 8 to 10, comparing the cold rolled steel sheet before a galvanized treatment in which the parent phase is a microstructure of ferrite-pearlite with the cold rolled steel sheet before a galvanized treatment in which the parent phase is a microstructure of tempered martensite or tempered bainite, it is understood that the latter microstructure is better than the former microstructure to improve relatively good balanced properties between a tensile strength (TS) and a total elongation (E1) and a hole enlarging rate (λ) by selection of preferred alloy heating treatment temperature and time (as shown in FIGS. 8 and 9).

Also in the retained γ property of the microstructure, comparing the former material with the latter material, it is understood that the former material can get a better property than that of the latter material by selection of a preferred alloy heat treating temperature.

What is claimed is:

1. A high tensile strength steel sheet comprising a matrix and a second phase, wherein the matrix comprises at least tempered martensite or tempered bainite, and optional ferrite, and the second phase comprises retained austenite, wherein the retained austenite comprises lath-like retained austenite having a long axis/short axis ratio of 3 or larger at 60% or larger by area relative to total retained austenite, and wherein (1) the steel comprises C: 0.10 to 0.6 mass %, Si: 1.0 mass % or smaller, Mn: 1.0 to 3 mass %, Al: 0.3 to 2.0 mass %, P: 0.02 mass % or smaller, and S: 0.03 mass % or smaller, (2) a volume rate of retained austenite, obtained by a saturated magnetization measuring method, is 10 to 40% by volume, and (3) a relationship of a carbon amount in mass % in the steel, a volume rate (fγR) of retained austenite and a carbon concentration (CγR) of the retained austenite satisfies the following equation (I):

$$(f\gamma R \times C\gamma R)/C > 50 \quad \text{(I).}$$

2. The high tensile strength steel sheet according to claim 1, wherein the steel further comprises at least one selected from the group consisting of Ca: 0.003 mass % or smaller, and REM: 0.003 mass % or smaller.

3. The high tensile strength steel sheet according to claim 1, wherein the steel further comprises at least one selected from the group consisting of Nb: 0.1 mass % or smaller, Ti: 0.1 mass % or smaller, and V: 0.1 mass % or smaller.

4. The high tensile strength steel sheet according to claim 1, wherein the steel further comprises at least one selected from the group consisting of Mo: 2 mass % or smaller, Ni: 1 mass % or smaller, Cu: 1 mass % or smaller, and Cr: 2 mass % or smaller.

5. The high tensile strength steel sheet according to claim 1, wherein the matrix comprises tempered martensite, tempered bainite and ferrite, having an area rate, when measured with an optical microscope photograph, as follows:

tempered martensite: 20 to 90% by area, tempered bainite: 20 to 90% by area, and ferrite: 0 to 60% by area.

6. The high tensile strength steel sheet according to claim 1, which has a surface processed by galvanizing.

7. The high tensile strength steel sheet according to claim 6, wherein the galvanizing process is a melting-galvanizing process.

8. The high tensile strength steel sheet according to claim 6, wherein after the galvanizing process, the steel sheet is further subjected to an alloy heating process.

9. The high tensile strength steel sheet according to claim 1, wherein the steel sheet exhibits a tensile strength (TS) of 750 to 1050 MPa and a relationship of a tensile strength (TS), a total elongation (E1) and a hole enlarging rate (λ) within the steel sheet satisfies the following equations:

$$TS \times E1 > 22{,}000,\ TS \times \lambda > 20{,}000$$

wherein TS represents a tensile strength measurement in MPa, E1 represents a total elongation measurement in %, and λ represents a hole enlarging rate measurement in %.

10. A method of preparing the high tensile strength steel sheet according to claim 1, wherein the method comprises:

providing a steel sheet comprising C: 0.10 to 0.6 mass %, Si: 1.0 mass % or smaller (including 0% by mass), Mn: 1.0 to 3 mass %, Al: 0.3 to 2.0 mass %, P: 0.02 mass % or smaller, and S: 0.03 mass % or smaller, with martensite or bainite introduced therein, cold rolling of the steel sheet at a rolling reduction rate of 30% or smaller, heating the steel sheet to a ferrite-austenite 2-phase region temperature, and retaining the steel sheet in a temperature range of 450 to 550° C. for an austemper time of 10 to 500 seconds.

11. The method of preparing the high tensile strength steel sheet according to claim 10, which further comprises:

subjecting the steel sheet to a galvanizing process and an optional alloy heating process.

12. A high tensile strength steel sheet comprising a matrix and a second phase, wherein the matrix comprises at least tempered martensite or tempered bainite, and optional ferrite, and the second phase comprises retained austenite, wherein the retained austenite comprises lath-like retained austenite having a long axis/short axis ratio of 3 or larger at 60% or larger by area relative to total retained austenite, wherein (1) the steel comprises C: 0.10 to 0.6 mass %, Si: 1.0 mass % or smaller, Mn: 1.0 to 3 mass %, Al: 0.3 to 2.0 mass %, P: 0.02 mass % or smaller, and S: 0.03 mass % or smaller, (2) a volume rate of retained austenite, obtained by a saturated magnetization measuring method, is 10 to 40% by volume, and (3) a relationship of a carbon amount in mass % in the steel, a volume rate (fγR) of retained austenite and a carbon concentration (CγR) of the retained austenite satisfies the following equation (I):

$$(f\gamma R \times C\gamma R)/C \geqq 50, \text{ and} \quad \text{(I)}$$

wherein the high tensile strength steel sheet is prepared by a method comprising:

providing a steel sheet comprising C: 0.10 to 0.6 mass %, Si: 1.0 mass % or smaller (including 0% by mass), Mn: 1.0 to 3 mass %, Al: 0.3 to 2.0 mass %, P: 0.02 mass % or smaller, and S: 0.03 mass % or smaller, with martensite or bainite introduced therein, cold rolling of the steel sheet at a rolling reduction rate of 30% or smaller, heating the steel sheet to a ferrite-austenite 2-phase region temperature, and retaining the steel sheet in a temperature range of 450 to 550° C. for an austemper time of 10 to 500 seconds.

13. The high tensile strength steel sheet according to claim 12, wherein the method further comprises:

subjecting the steel sheet to a galvanizing process and an optional alloy heating process.

14. The high tensile strength steel sheet according to claim 12, wherein the method further comprises:

subjecting the steel sheet to a galvanizing process, and subjecting the steel sheet to an alloy heating process.

15. The high tensile strength steel sheet according to claim 12, wherein the steel further comprises at least one selected from the group consisting of Ca: 0.003 mass % or smaller, and REM: 0.003 mass % or smaller.

16. The high tensile strength steel sheet according to claim 12, wherein the steel further comprises at least one selected from the group consisting of Nb: 0.1 mass % or smaller, Ti: 0.1 mass % or smaller, and V: 0.1 mass % or smaller.

17. The high tensile strength steel sheet according to claim 12, wherein the steel further comprises at least one selected from the group consisting of Mo: 2 mass % or smaller, Ni: 1 mass % or smaller, Cu: 1 mass % or smaller, and Cr: 2 mass % or smaller.

18. The high tensile strength steel sheet according to claim 12, wherein the matrix comprises tempered martensite, tempered bainite and ferrite, having an area rate, when measured with an optical microscope photograph as follows:

tempered martensite: 20 to 90% by area, tempered bainite: 20 to 90% by area, and ferrite: 0 to 60% by area.

19. The high tensile strength steel sheet according to claim 12, wherein the steel sheet exhibits a tensile strength (TS) of 750 to 1050 MPa and a relationship of a tensile strength (TS), a total elongation (E1) and a hole enlarging rate (λ) within the steel sheet satisfies the following equations:

$$TS \times E1 \geqq 22{,}000,\ TS \times \lambda \geqq 20{,}000$$

wherein TS represents a tensile strength measurement in MPa, E1 represents a total elongation measurement in %, and λ represents a hole enlarging rate measurement in %.

20. The high tensile strength steel sheet according to claim 12, wherein the retained austenite comprises lath-like retained austenite having a long axis/short axis ratio of 3 or larger at 65% or larger by area relative to total retained austenite, wherein the volume rate of retained austenite is 10 to 30% by volume, and wherein said cold rolling of the steel sheet is conducted at a rolling reduction rate of 5-25%.

21. The high tensile strength steel sheet according to claim 12, wherein the retained austenite comprises lath-like retained austenite having a long axis/short axis ratio of 3 or larger at 70% or larger by area relative to total retained austenite, wherein the volume rate of retained austenite is 10 to 20% by volume, and wherein said cold rolling of the steel sheet is conducted at a rolling reduction rate of 10-20%.

* * * * *